US009347635B2

(12) United States Patent
Suckling et al.

(10) Patent No.: US 9,347,635 B2
(45) Date of Patent: May 24, 2016

(54) HEADLIGHT SYSTEM INCORPORATING ADAPTIVE BEAM FUNCTION

(71) Applicant: SHARP KABUSHIKI KAISHA, Osaka (JP)

(72) Inventors: James Rowland Suckling, Surrey (GB); David James Montgomery, Oxford (GB); Sarah Anne Mitchell, Oxford (GB); Koji Takahashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 169 days.

(21) Appl. No.: 13/948,682

(22) Filed: Jul. 23, 2013

(65) Prior Publication Data

US 2014/0029279 A1 Jan. 30, 2014

(30) Foreign Application Priority Data

Jul. 26, 2012 (GB) ..... 1213297.3

(51) Int. Cl.
*F21S 8/10* (2006.01)

(52) U.S. Cl.
CPC ..... *F21S 48/17* (2013.01); *F21S 48/1145* (2013.01); *F21S 48/1154* (2013.01); *F21S 48/1241* (2013.01); *F21S 48/1258* (2013.01); *F21S 48/1721* (2013.01); *F21S 48/1736* (2013.01); *F21S 48/1742* (2013.01); *F21S 48/1747* (2013.01); *F21S 48/328* (2013.01)

(58) Field of Classification Search
CPC ... F21S 48/17; F21S 48/1145; F21S 48/1258; F21S 48/1747; F21S 48/1241; F21S 48/1742; F21S 48/1154; F21S 48/1736; F21S 48/1721; F21S 48/328
See application file for complete search history.

(56) References Cited

U.S. PATENT DOCUMENTS

| | | | | |
|---|---|---|---|---|
| 7,163,327 | B2 * | 1/2007 | Henson et al. | 362/554 |
| 7,654,712 | B2 | 2/2010 | Takeda et al. | |
| 8,708,537 | B2 * | 4/2014 | Takahashi | F21S 48/1145 362/259 |
| 2011/0249460 | A1 | 10/2011 | Kushimoto | |
| 2012/0051074 | A1 | 3/2012 | Takahashi | |
| 2012/0069593 | A1 * | 3/2012 | Kishimoto et al. | 362/511 |

FOREIGN PATENT DOCUMENTS

| | | | |
|---|---|---|---|
| EP | 2 063 170 | A2 | 5/2009 |
| EP | 2 447 600 | A2 | 5/2012 |
| JP | 2011-134619 | A | 7/2011 |
| WO | WO 2013/094222 | A1 | 6/2013 |

* cited by examiner

*Primary Examiner* — Sharon Payne
(74) *Attorney, Agent, or Firm* — Renner, Otto, Boisselle & Sklar, LLP

(57) ABSTRACT

A light source system comprising projection optics, which are capable of producing a far-field image of a light source. The light source comprises a fluorescent medium that when illuminated by light from laser emitters of a first waveband emits light of a second or more wavebands of longer wavelength. The resulting light emission produces a colour perceived as white. The light source is illuminated by a plurality of laser emitters arranged to illuminate the light source in an array-like manner. Control of the output of one or more of the laser emitters results in a variation of the spatial emission distribution from the light source and hence a variation of the far-field beam spot distribution. Further, fine variation of the far-field beam spot distribution may be achieved by re-direction of the laser beams by separate control methods.

20 Claims, 23 Drawing Sheets

PRIOR ART

PRIOR ART

PRIOR ART

HEADLIGHT SYSTEM INCORPORATING ADAPTIVE BEAM FUNCTION

This Nonprovisional application claims priority under 35 U.S.C. §119(a) on Patent Applications No. 1213297.3 filed in United Kingdom on Jul. 26, 2012, the entire contents of which are hereby incorporated by reference.

TECHNICAL FIELD

The present invention relates to a headlight system for the provision of an illumination pattern on the road which may be adapted to best suit driving conditions.

BACKGROUND ART

The application of lighting to the automotive industry is well known. The original electric light sources were filament bulbs which offered high luminance from a small source. Improvements in light source design led to halogen type filament bulbs, high intensity discharge (HID) bulbs or high brightness light emitting diodes (LED). These offer improvement in terms of luminance and energy use over preceding filament bulbs. In order to apply these light sources to automotive front lighting and realise the beam spot distributions required by regulatory bodies, such as the United Nations Economic Commission for Europe (UNECE) or Federal Motor Vehicle Safety Standards (FMVSS), for the U.S.A, modification of the output beam to form specific beam spot distributions on the road is necessary. For projector headlights this requires removal of a portion of the light from the projected beam which ultimately forms the beam spot, to create a dipped beam. The dipped beam is necessary to avoid causing glare to oncoming road users. By necessity, the dipped beam also creates a restricted view of the road due to restricted illumination of the same. The removal of light is performed by a shield, which is inserted into the light path thereby causing a reduction in optical efficiency of the projector headlight.

The filament and discharge light sources provide no means for modification of the output from the source. Therefore, a shield is the only method of providing the dipped beam spot distribution pattern. To switch between a dipped beam and a driving beam, the beam pattern that is necessary for better visibility, either two headlights must be provided, one to create the dipped beam and the other to create the driving beam, or a mechanical switching mechanism must be provided. When the driving beam is desired, the mechanical switching mechanism removes the shield from the projected beam profile allowing all light to exit the projector headlight unit unimpeded.

The provision of only a dipped beam distribution, or of only a driving beam distribution, has limitations in terms of road user safety by not providing simultaneous optimal illumination of the road and minimal glare to other road users. This can be improved upon by the addition of an adaptive element to the projected headlight beam. However, all methods of creating an adaptive beam spot from a single projector unit require mechanical moving components within the headlight unit. This has a limitation on cost reduction and reliability of the headlight over the course of its lifetime. Alternative methods of provision of an adaptive beam spot require multiple light source units, which increases the headlight cost, and which also have a large volume, this having implications for pedestrian safety in the event of a collision.

Laser based light sources offer advantage over existing light sources due to the ability to control the emission from the laser diode effectively using optics with a much reduced size, and therefore, weight. This control ability stems from the small emission area and restricted angular distribution of the laser diode. The light emitted from laser diodes is often illuminated onto a fluorescent material to convert from the first wavelength to a second wavelength, which is predominantly white. The light source created is very small and can be used more efficiently with headlight projection optics.

The following background art describes the use of lasers in automotive headlight units:

JP 2011-134619 A (Stanley Electric, 25 Dec. 2009); an illustration of this patent is shown in FIG. 1. This patent discloses the use of a solid state light source 11 which can be scanned across a fluorescent material layer 12 to form a controllable light source, emitting white or coloured light. The scanning is performed by a moveable reflective method 13, for example mirror. The light is then projected by means of an optical system 14, for example a lens.

EP 2,063,170 A2 (Audi AG, 21 Nov. 2007); an illustration of this patent is shown in FIG. 2. The patent discloses the use of a source of light 21, a two dimensional element 22, a means 23 to image the two dimensional element 22 and a scanning reflector 24. The light source 21 may be a laser diode. The reflector 24 is scanned to move the light emitted 25 from the light source 21 across the two dimensional element 22. This creates a projected distribution 26 of the two dimensional element 22 onto the road surface 27. The reflector 24 is scanned faster than the eye can perceive. The two dimensional element 22 may be formed by a fluorescent material.

US 2012/0051074 A1 (Sharp, 31 Aug. 2010); and illustration of this patent is shown in FIG. 3. The patent discloses a headlight 310 comprising a fluorescent member 31 which is irradiated by laser light 32 emitted by a laser generator 34. The laser generator may be comprised of multiple semiconductor laser devices 37. The position of irradiation is changed by an irradiated position changer 33 which alters the direction of the laser light 32. The irradiated position changer 33 may be formed from a collimating lens which can be rotated by an actuator 35. The angle of the irradiated position changer 33 is defined by the angle of steering of the vehicle; this is detected by a steering angle detector 36. The light is transported from the semiconductor laser devices 37 by optical fibres 38. The fibres are bundled together at their light emitting end 39. The role of the irradiated position changer is to collimate the light and steer the direction of the laser light 32. Only one irradiated position 33 changer is disclosed. The position of irradiation on the fluorescent member 31 defines the direction of projection of the light by a light projecting member 311. The output from the laser generator 34 may be altered dependent on position of irradiation of laser light 32 upon the fluorescent member 31. The patent discloses alteration of both the position of irradiation and area of irradiation.

U.S. Pat. No. 7,654,712 B2 (Koito Manufacturing, 28 Jun. 2006); an illustration of this patent is shown in FIG. 4. This patent discloses a lamp module 41 formed from multiple elements formed from a fluorescent substance 42 excited by individual light emission parts 43 to emit white light. The fluorescent emission from the fluorescent substance 42 is collimated by a plurality of micro lenses 44. This light can then be projected by another lens to form a beam spot. This has the capability to form an adaptive beam spot. The level of fine control of the beam spot is defined by the number of laser diodes.

US 2011/0249460 (T. Kushimoto, 13 Apr. 2011) proposes a vehicle headlight having an array of phosphor squares, which are illuminated by light from blue laser sources. Light from a laser source is directed onto the phosphor grid by a mirror. The lasers can be scanned to obtain different illumination patterns. In addition to the illumination provided by the phosphor grid, the headlight also has a further light source such as a projector or reflector headlight.

EP 2447600 (Stanley Electric Co Ltd, 2 May 2012) proposes a lighting unit that may be for a vehicle headlight. It has a phosphor member that is illuminated by light from a laser diode. The phosphor member is mounted for rotation about its axis, and is shaped such that rotating the phosphor member by 90° about its axis will cause the output illumination pattern of the lighting unit to change.

SUMMARY OF INVENTION

A first aspect of the present invention provides a light source system operable in at least first and second modes to provide at least a first and second different far field illumination patterns, the system comprising: a photoluminescent material; a light beam generator for generating, in the first and second modes respectively, first and second independently controllable sets of one or more light beams for illuminating respective regions of the photoluminescent material, wherein the light beam generator comprises at least one semiconductor light emitting device spatially separated from the photoluminescent material; a control means for controlling, in the first mode, the position, size, shape and/or orientation of at least one region of the photoluminescent material illuminated by a respective light beam of the first set of one or more light beams; optical control elements, each optical control element for directing one or more respective light beams towards the photoluminescent material; wherein the control means control the incidence of the light beams on respective optical control elements; and one or more transmission components for transmitting light beams towards the optical control elements, the one or more transmission components comprising at least one optical fibre.

By specifying that the first and second sets of light beams are independently controllable is meant that the intensity and spatial arrangement of the light beam(s) of one set is controllable independently of the intensity of the beam, or of any of the light beams, of the other set, and optionally that the or any light beam of one set is controllable independently of the intensity of the or any light beam of the other set. (It should be noted that the region of the photoluminescent material that is illuminated by one set of light beams may or may not overlap the region of the photoluminescent material that is illuminated by another set of light beams.)

For the avoidance of doubt, the first set of light beams and/or the second set of light beams may consist of only a single light beam.

The photoluminescent material may be a fluorescent material, such as a fluorescent phosphor.

For the avoidance of doubt, the term "phosphor" as used herein includes a nanophosphor.

Also for the avoidance of doubt, a light system of the invention is not necessarily limited to operation in just the first and second modes and in principle may also be operable in further modes in addition to the first and second modes.

A light source system of the invention not only can provide different far-field illumination pattern (through being operable in either the first mode or in the second mode) but also can allow the far field illumination pattern obtained in at least the first mode to be varied, by controlling the position, size, shape and/or orientation of at least one region of the photoluminescent material that is illuminated in the first mode. This allows greater control over the illumination pattern that is provided. At the same time, compared to a conventional lighting system in which the far-field illumination pattern is varied solely by mechanical means (such as in JP 2011-134619), a light source system of the invention is more reliable—even if the control means should fail a light source system of the invention can still provide different far-field illumination patterns, since the switching of the light source system between the first mode and the second mode is independent of the control means and a failure of the control means does not affect the ability to operate in either the first or second modes of operation.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DESCRIPTION OF REFERENCE NUMERALS

Figure 1:
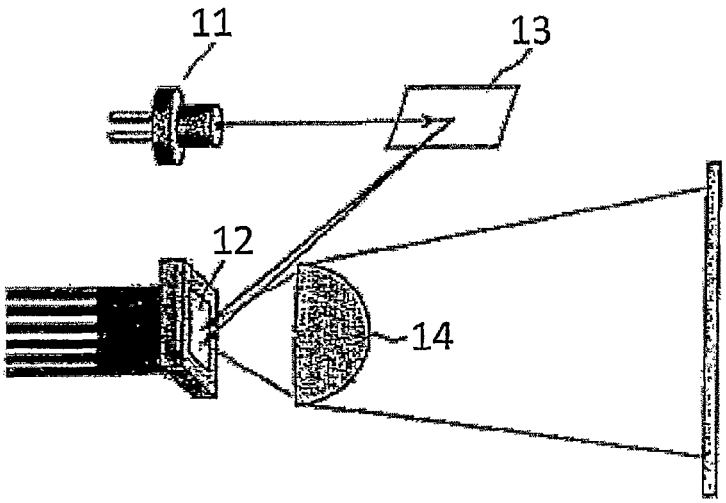
FIG. 1: example of laser based headlight unit with fine control of the projected beam spot, constituting a conventional art.
Figure 2:
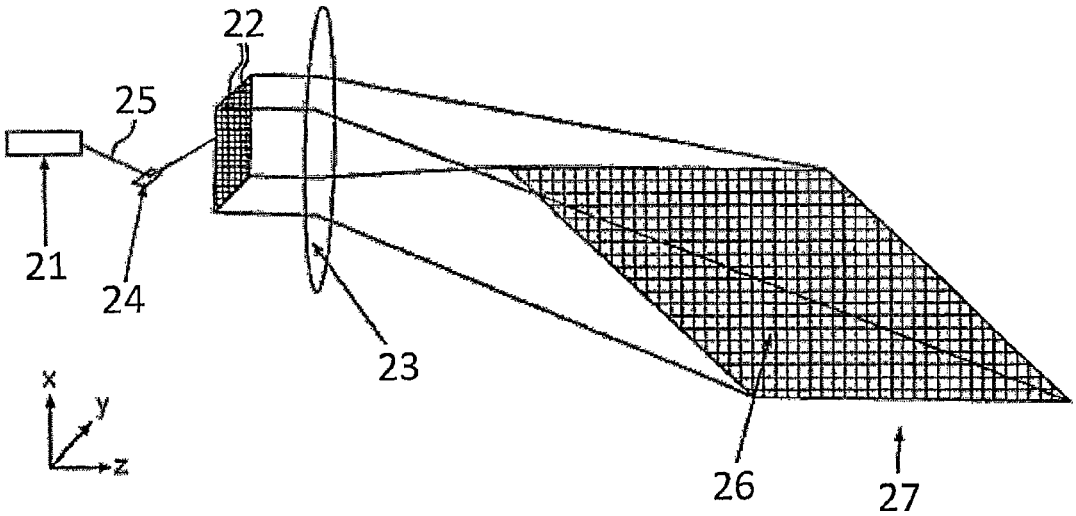
PRIOR ART FIG. 2
FIG. 2: example of laser based headlight with fine control of the projected beam spot, constituting a conventional art.
Figure 3:
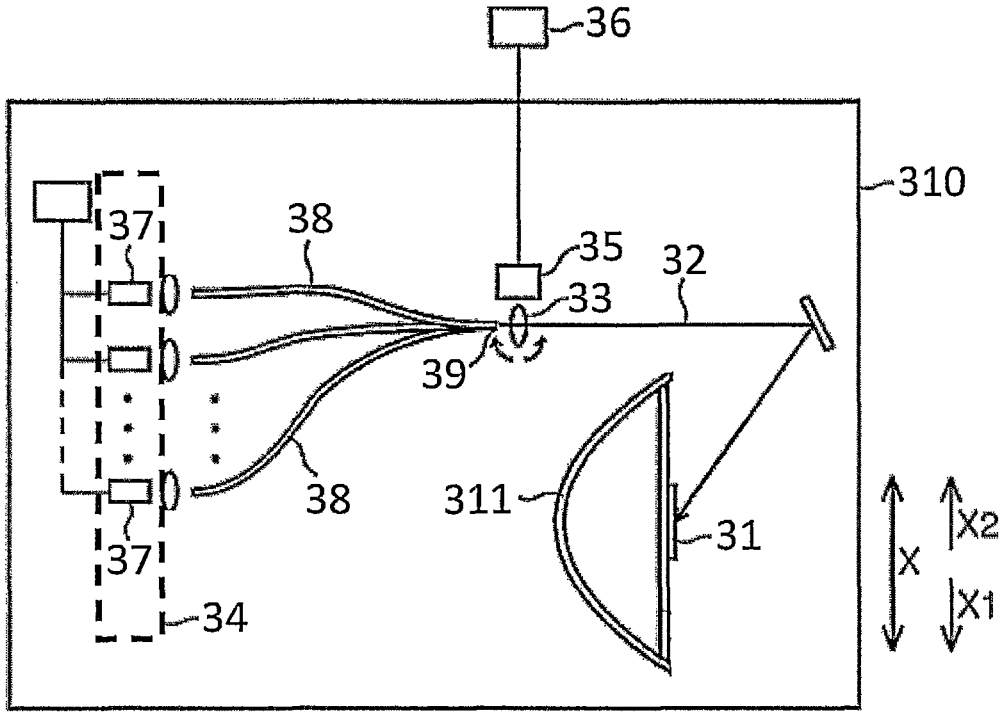
FIG. 3: example of laser based headlight with fine control of the projection direction of the output beam, constituting a conventional art.
Figure 4:
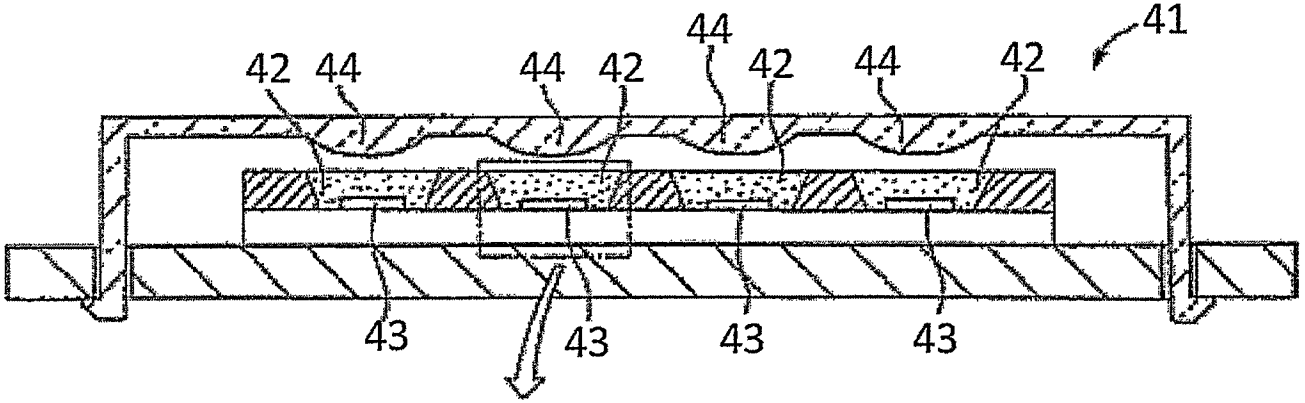
FIG. 4: example of a laser based headlight with adaptive control of a projected beam spot, constituting a conventional art.

11. solid state light source (prior art 1)
12. fluorescent material layer (prior art 1)
13. reflective method (prior art 1)
14. optical system (prior art 1)
21. source of light (prior art 2)
22. two dimensional element (prior art 2)
23. mean to image two dimension al element (prior art 2)
24. scanning reflector (prior art 2)
25. light emitted from the light source (prior art 2)
26. projected distribution (prior art 3)
27. road surface (prior art 3)
31. light emitting member (prior art 3)
32. laser light (prior art 3)
33. irradiated position changer (prior art 3)
34. laser generator (prior art 3)
35. actuator (prior art 3)
36. steering angle detector (prior art 3)
37. semiconductor laser devices (prior art 3)
38. optical fibres (prior art 3)
39. light emitting end (prior art 3)
310. headlight (prior art 3)
311. light projecting member (prior art 3)
51. light beam generator
52. laser emitters
53. light beams of the first waveband
54. light source
55. fluorescent material
56. substrate
57. illumination spots
57*a*. particular illumination spot
58. secondary light
59. optical system
510. primary lens
511. array
512. array boundaries
513. heat sink
514. optical control element
515. original position of illumination spot
516. new position of illumination spot
517. larger size of illumination spot
518. rotated orientation of illumination spot
519. original orientation of illumination spot
520. original size of the illumination spot
61. optical fibre
62. optical fibre output face
63. actuator
64. sleeve
65. cladding
66. core
67. rectilinear shape
71. lateral movement (of the optical fibre)
72. direction of the axis (of the optical fibre)
73. anchor point
74. rotation movement (of the optical fibre)
75. pivot point
76. axially aligned linear movement (of the optical fibres)
77. axial rotation (of the optical fibres)
81. lateral movement (of the optical control elements)
82. pivot axis
83. rotation movement (of the optical control element)
84. axially aligned linear movement (of the control optical elements)
91. optical distribution components
92. shaped distribution
101. single compound distribution
121. ellipsoidal reflectors (optical control elements)
122. light source system
123. first focal point
124. second focal point
131. headlight unit
132. automobile
133. central control unit
134. beam spot distribution on the road
135. road
136. driver console
137. camera
138. oncoming automobile
139. person

DETAILED DESCRIPTION OF INVENTION

Figure 5A:
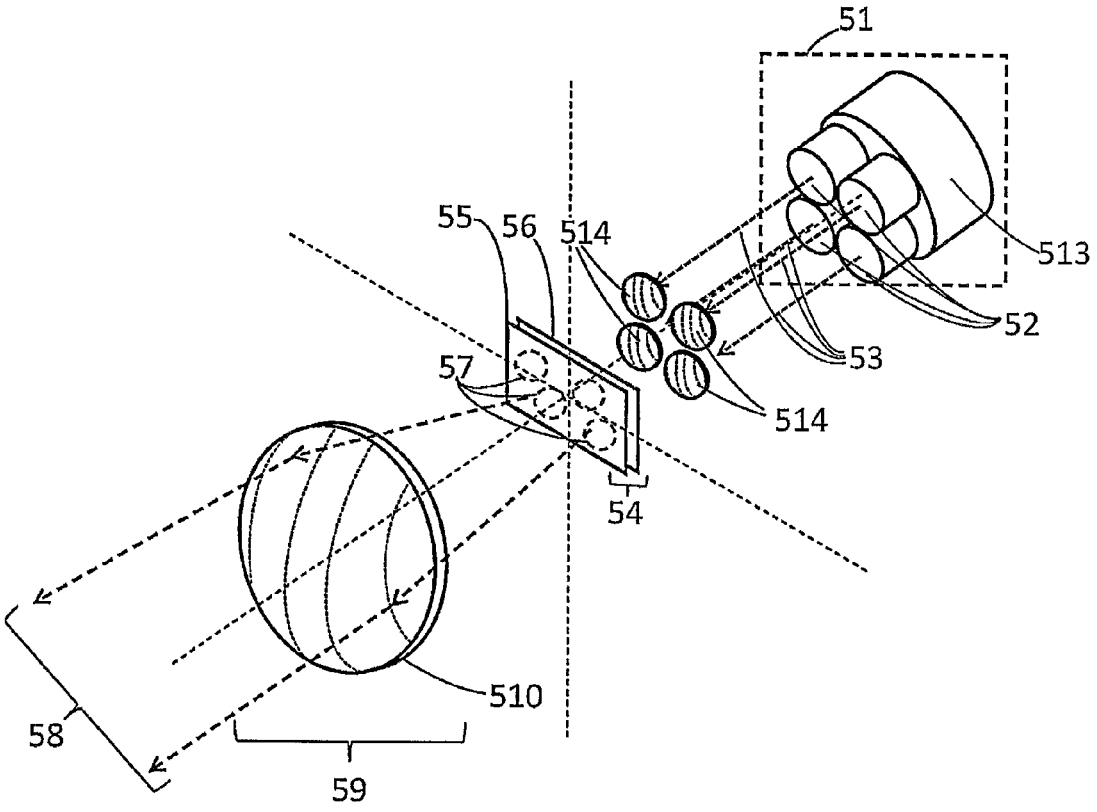
FIG. 5*a*: general mode of operation of the light source system.

The general mode of operation of the present invention is described herein and an overview of the same is presented in FIG. 5*a*. A light beam generator 51 is constructed such that it may generate multiple light beams 53. The light beam generator is operable in at least first and second modes in which it generates respectively, first and second independently controllable sets of one or more light beams for illuminating respective regions of the photoluminescent material. For example the light beam generator 51 may be capable of generating N (where N is an integer) light beams and may be operated such that in a first mode a first set of light beams selected from the N light beams is generated with light emitters corresponding to light beams that are not in the first set being turned off, and may be operated such that in a second mode a second set of light beams selected from the N light beams is generated with the second set being different to the first set and with light emitters corresponding to light beams that are not in the second set being turned off. In its simplest form it is comprised of an array of multiple individual laser emitters 52, but should not limited to such. In one preferred embodiment the individual light emitters 52 are controllable independently from one another, so that the first/second set of light beams may be obtained by turning on a corresponding first/second set of light emitters with other light emitters being turned off. In principle each light emitter may be operable just in an "off" state or in an "on" state, but optionally one or more, possibly all, of the light emitters may be operable in one or more states that provide intermediate power outputs that is/are less than the output power in a fully "on" state. The laser emitters 52 may be mounted on a heat sink 513 if necessary. From herein the heat sink 513 will be omitted from figures for clarity, but may always be associated with laser emitters 52 or a light beam generator 51. The laser emitters 52 emit light beams 53 of a first waveband. The light beams 53 of the first waveband from the laser emitters 52 are directed onto a light source 54 comprising a fluorescent material 55 which it deposited onto a substrate 56. From herein the light source 54 will generally be shown as one object. The individual light beams 53 form an array of illumination spots 57 on the light source 54 which are distinct, but not necessarily separated from one another. The fluorescent material 55 converts the light of the first waveband into light of a second or more wavebands with longer wavelength. The secondary light 58 of the second waveband is subsequently emitted from the light source 54 is collected by an optical system 59 which images the light source 54 into the far field. The optical system 59 is shown as a primary lens 510 in this embodiment for illustrative purposes, but should not be limited to one such type of image forming apparatus.

The system of FIG. 5*a* further comprises optical control elements, each optical control element directing one or more respective light beams towards the fluorescent material 55 of the light source 54. Each of the light beams 53 passes through an optical control element 514, such that there is at least one optical control element 514 per light beam 53. The optical control elements 514 are shown as refractive lenses in this embodiment, but should not be limited to one such type. The optical control elements 514 act to change the direction or angular divergence of the light beam 53 emitted from the output surface of the optical control element 514, if the light beam 53 moves with respect to the input surface of the optical control element 514. The input surface is defined as the one at which the light beam 53 enters the optical control element 514. The output surface is defined as the one at which the light beam 53 leaves the optical control element 514.

The system of FIG. 5*a* further comprises one or more transmission components for transmitting light beams towards the optical control elements. In the embodiment of FIG. 5*a* the one or more transmission components comprise at least one optical fibre.

The movement of the light beam 53 with respect to the optical control element 514 may be achieved by a change in direction or position of the light beam 53. The movement of the light beam 53 may be created by the re-positioning or re-orientation of the optical control element 514 with respect to the light beam generator 51 using a suitable control means or, conversely, by the repositioning or re-orientation of the light beam generator 51 with respect to the optical control element 514 using a suitable control means. By this control method, the light beams 53 may be deflected away from the original position of the array of illumination spots 57 upon the light source 54. Similarly, by this method, the size of the illumination spots 57 on the light source 54 may also be changed from the original size. By this control of the light beams 53 a finer control over the distribution of the array of illumination spots 57 may be achieved than was possible with the original fixed number of laser light emitters 52.

For the purposes of description of the present invention, when describing the light source 54, it is understood that the term "illumination spot" is directly equivalent to "emission spot" as the light source 54 only emits light of the second or more wavebands from a position illuminated by light of the first waveband from the laser emitters 52 and that emission of light from the light source 54 is otherwise not possible. Therefore, discussion of illumination from the laser emitters 52 implicitly indicates emission from the light source 54.

The laser emitters 52 may be replaced with other semiconductor light emitters, for example light emitting diodes (LED) which are applied with a suitable collimating optic to direct the light from the LED onto the fluorescent material 55 of the light source 54. Use of such LEDs will result in a headlight which is significantly larger than one constructed using laser emitters.

The fluorescent material 55 may be made from phosphors and deposited on the substrate 56 in a thin layer, the manufacture of which is well known and will not be disclosed further within this invention. The constituent parts of the fluorescent material 55 may vary depending on the wavelength of the first waveband and hence the formation of the second or more wavebands of light may be via two routes. Firstly, the light of the first waveband may be non-visible, or have a wavelength such that it generates a very low response in the human eye, such wavelengths being 415 nm or shorter. In this instance, the fluorescent material 55 may be constituted of a combination of two or more of red, green, blue or yellow phosphors which are caused to emit light within the red, green, blue or yellow second wavebands respectively when illuminated by light of 415 nm or shorter. The combination of two or more of the aforementioned second wavebands, but excluding the first waveband produced by the laser emitter, may be mixed to produce light perceived as white. The second method of producing white light via the use of a first waveband in the range 430 nm to 470 nm and a combination of one or more of a red, green or yellow phosphor which is caused to emit light within the red, green or yellow second wavebands respectively when illuminated by light within the range of 430 nm to 470 nm. The combination of the part of light of the first waveband that is not absorbed by the fluorescent material and one or more of the second wavebands produces light with a colour perceived as white.

Figure 5B:
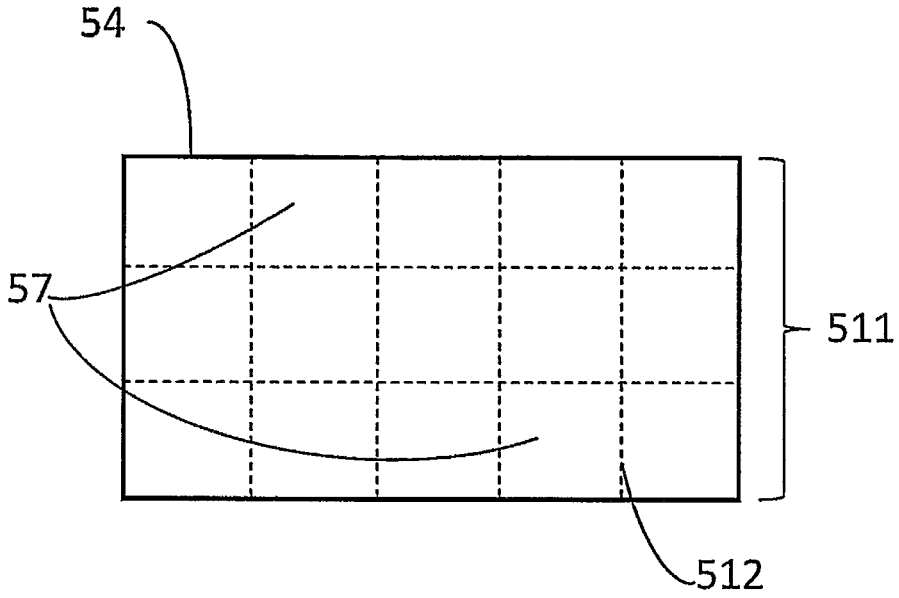
FIG. 5*b*: detail of the array of illumination spots created upon the light source.

FIG. 5*b* shows a plan view of the light source 54 in which the illumination spots 57 form an array 511 which illuminates the whole of the light source 54, the dashed lines representing boundaries 512 between the different illumination spots 57. Each laser emitter illuminates an individual illumination spot 57. It is not necessary for the illumination spots 57 to be contained completely within the array boundaries and some overlap of the adjacent cells of the array 511 is allowed, but this is not shown for clarity of the illustration. The relative intensity of each section of the array 511 on the light source 54 may be controlled by altering the output power of each of the laser emitters 52, thereby controlling the intensity of emission from the light source 54 as a function of spatial position. The spatial brightness variation of the light source 54 is imaged into the far-field by the optical system creating a freely adaptive beam spot.

The individual illumination spots 57 within the array 511 may be each formed from the light from individual single laser emitters. Alternatively, it is also possible for the individual illumination spots 57 to be formed from the light from more than one laser emitter. In the case of the latter, the light from the multiple laser emitters is expected to overlap completely to provide a single illumination spot 57, such that the variation of output from the laser emitters incorporated into one illumination spot 57 will only result in a change in brightness of emission from the illuminated spot 57 and not a change in shape of the illumination spot 57. This will offer a degree of redundancy if one of the laser emitters should happen to fail or reduce in output power. The complete array 511 can then still formed from multiple illumination spots 57, each formed by illumination from multiple laser emitters.

Figure 5C:
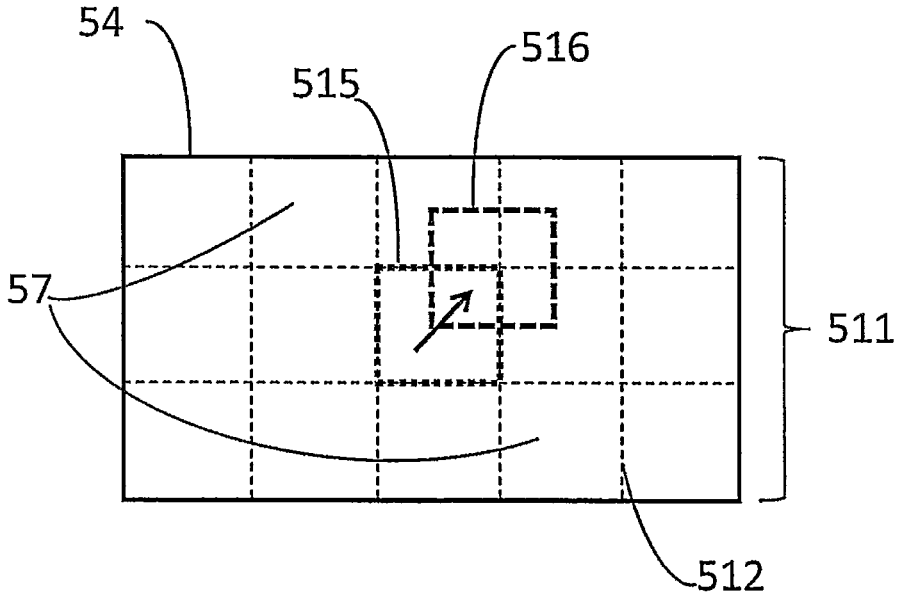
FIG. 5*c*: illustration of the movement of an illumination spot from its original position within the array upon the light source.

FIG. 5*c* shows a plan view of the light source 54 in which one particular illumination spot is moved with respect to the array 511 from its original position 515 to a new position 516. The diagram within FIG. 5*c* is to highlight the definition of movement of an illumination spot with respect to the array 511, not define the particular direction or magnitude of the movement. Each of the elements within the array will be capable of moving relative to their original position. The only restriction placed upon the particular illumination spots is that they have a default position within the array 511, as demonstrated by 515 for one of the illumination spots 515. As such if the optical control elements or the light beam generator are set in a default state, the illumination spots 57 with have a pre-defined position within the array 511. This pre-defined position may be determined at the point of design to have the desired configuration.

Figure 5D:
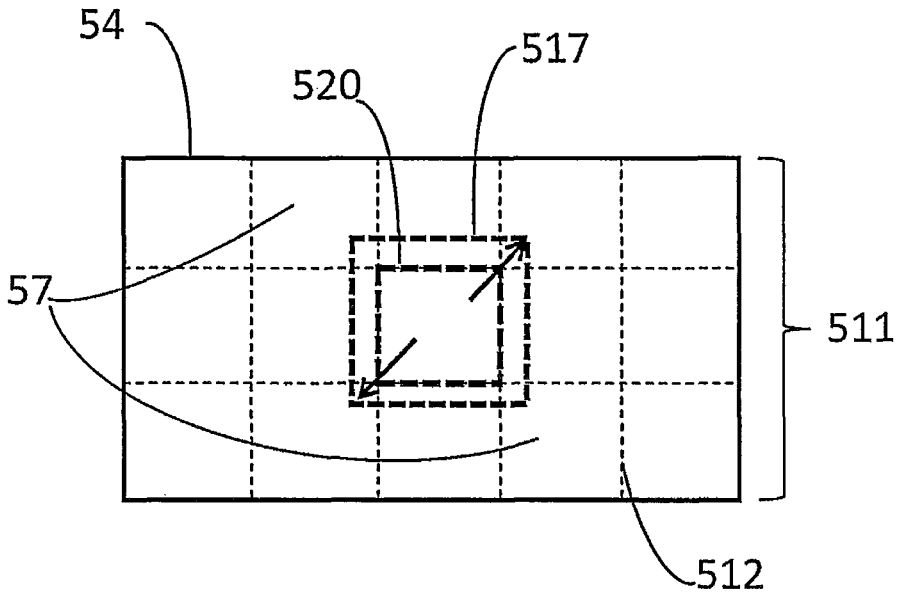
FIG. 5*d*: illustration of the change in size of an illumination spot from its original size within the array upon the light source.

FIG. 5*d* shows a plan view of the light source 54 in which one particular illumination spot is changed in size with respect to its original size 520 within the array to a larger size 517. The diagram within FIG. 5*d* is to highlight the definition of change of size of an illumination spot with respect to the array 511, not define the particular change in size or factor of scale change. Each of the elements within the array 511 will be capable of changing in size relative to their original size. The only restriction placed upon the particular illumination spots is that they have a default size within the array 511, as demonstrated by 520 for one of the illumination spots. As such if the optical control elements or the light beam generator as set in a default state, the illumination spots 57 will have a pre-defined size within the array 511. This pre-defined size may be determined at the point of design to have the desired configuration.

Figure 5E:
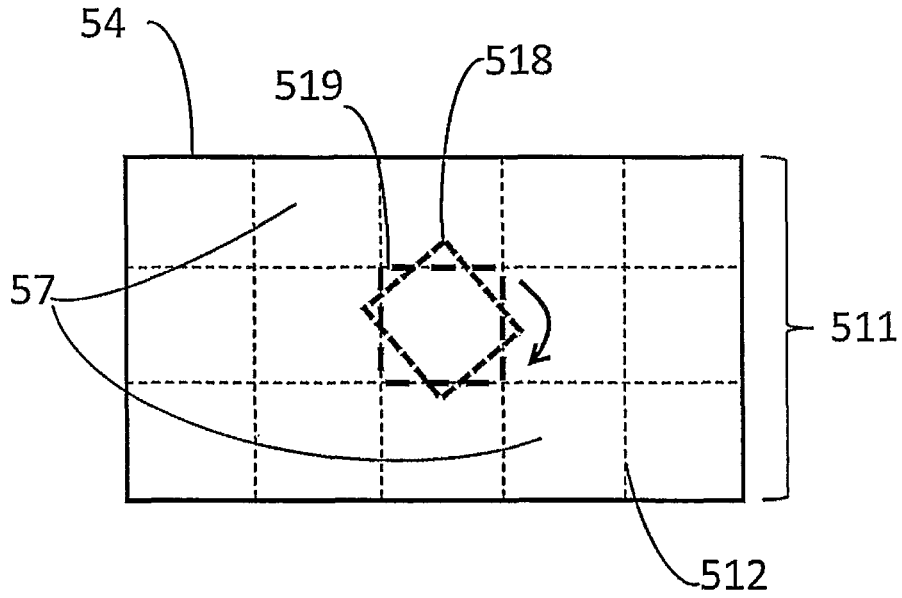
FIG. 5*e*: illustration of the change in orientation of an illumination spot on the light source by rotation.

FIG. 5*e* shows a plan view of the light source 54 in which one particular illumination spot is rotated with respect to its original orientation 519 within the array to a new orientation 518. The diagram in FIG. 5*e* is to highlight the definition of change in orientation of an illumination spot with respect to the array 511, not define the particular change in orientation. Each of the elements within the array 511 will be capable of changing in size relative to their original orientation. The only restriction placed upon the particular illumination spots is that they have a default orientation within the array 511, as demonstrated by 519 for one of the illumination spots. As such if the optical control elements or the light beam generator is set in a default state, the illumination spots 57 will have a pre-defined orientation within the array 511. This pre-defined orientation may be determined at the point of design to have the desired configuration.

Figure 6A:
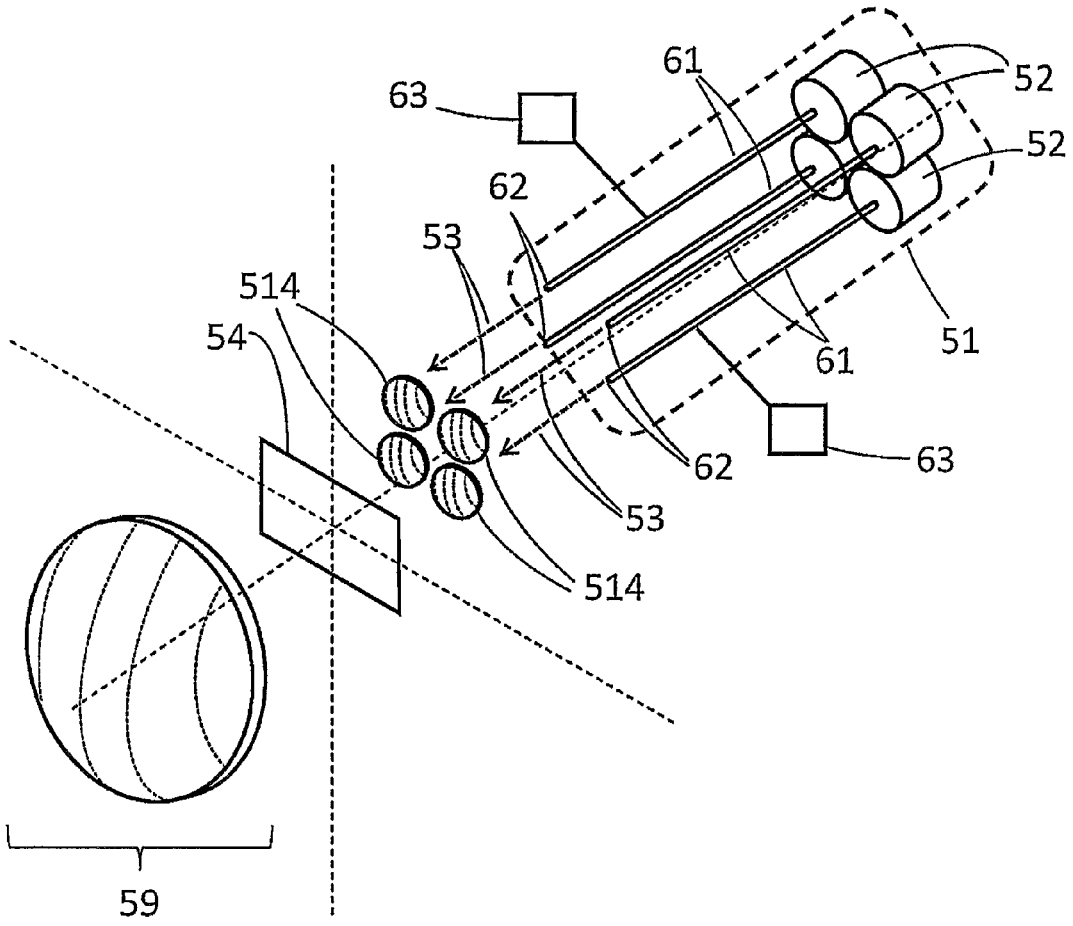
FIG. 6*a*: the preferred embodiment of the present invention, the light beam generator consisting of multiple laser emitters and optical fibres.

FIG. 6*a* shows a configuration whereby the light beam generator 51 is comprised of multiple individual laser emitters 52 and optical fibres 61. The configuration shown and described in FIG. 6*a* represents the preferred embodiment of the present invention. The light beam generator 51 of FIG. 6*a* is operable in at least first and second modes to obtain at least first and second different far-field illumination patters. In the first and second modes the light beam generator 51 generates, respectively, first and second independently controllable sets of one or more light beams for illuminating respective regions of the light source 54. For example in a first mode a first set of the laser emitters 52 may be turned on to generate the first set of light beams with laser emitters that are not in the first set of emitters being turned off, and in a second mode a second set of the laser emitters 52 may be turned on to generate the second set of light beams with laser emitters that are not in the second set of emitters being turned off, with the first set of light beams being different to the second set of light beams. The light from the laser emitters 52 is coupled into the optical fibres 61 (that, as described with reference to FIG. 5*a*, act as transmission components) and is transmitted to the optical fibre 61 output face 62. There is one optical fibre 61 per individual laser emitter 52. The light emitted from the optical fibre 61 output face 62 is deemed to be the light beam 53 which exits the light beam generator 51 as described above. Therefore, movement of the optical control components 514 is considered relative to the optical fibre 61 output face 62, as opposed to the individual laser emitters 52. Alternatively, the optical fibres 61 may be moved, and hence the fibre output face 62, with respect to the optical control components 514, again the individual laser emitters 52 remain static. The movement of the optical fibres 61 may be achieved by application of actuators 63 to the optical fibres 61. Actuators 63 may be applied to each and every optical fibre 61, if required, however it is not necessary that there is an actuator 63 per optical fibre 61. Some optical fibres 61 may not be attached to an actuator 63 and will therefore be static with respect to the optical control elements 514. The actuators 63 may be controlled independently from each other, or may be controlled to act as a whole, depending on the preferred operation. The actuators 63 are arranged such that they may move the optical fibres 61 laterally compared to the optical control elements 514, or in a directional towards or away from the optical control elements, or a combination of the two modes of movement. The actuators 63 thus form control means for controlling the incidence of light beams on respective optical control elements 514. By way of example, the actuators 63 may take the form of motors, solenoids, piezoelectric elements, pneumatic or hydraulic pistons, bi-metallic strips or micro-electromechanical (MEMs) devices.

In the configuration shown in FIG. 6*a* the optical control elements 514 are formed from a device which is capable of forming an image of the output face 62 of the optical fibre 61 upon the surface of the light source 54. An example of such a device may be a refractive lens, or diffractive element, but should not be limited to such devices. By this configuration, the output face 62 of the optical fibre 61 is placed at or close to the object focal plane of the optical control element 514 and the light source 54 is located at or close to the image focal plane of the optical control element 514. Movement of the output face 62 of the optical fibre 61 with respect to the focal plane of the optical control element 514 causes a change in the illumination spot upon the light source 54. Movement of the output face 62 of the optical fibre within the focal plane causes a change in position of the image which forms the illumination spot upon the light source 54. Likewise, movement which causes to the output face 62 of the optical fibre 61 to move away from the focal plane of the optical control element 514 causes a change in size of the image which forms the illumination spot upon the light source 54. It should be stated that movement of the output face 62 the optical fibre 61 relative to the focal plane may be achieved by moving either the optical fibre 62 or the optical control element 514. Furthermore, it is understood that each of the optical control elements 514 do not necessarily need to share a common focal plane and may have positions which are best optimised to the particular configuration of the light source system.

Figure 6B:
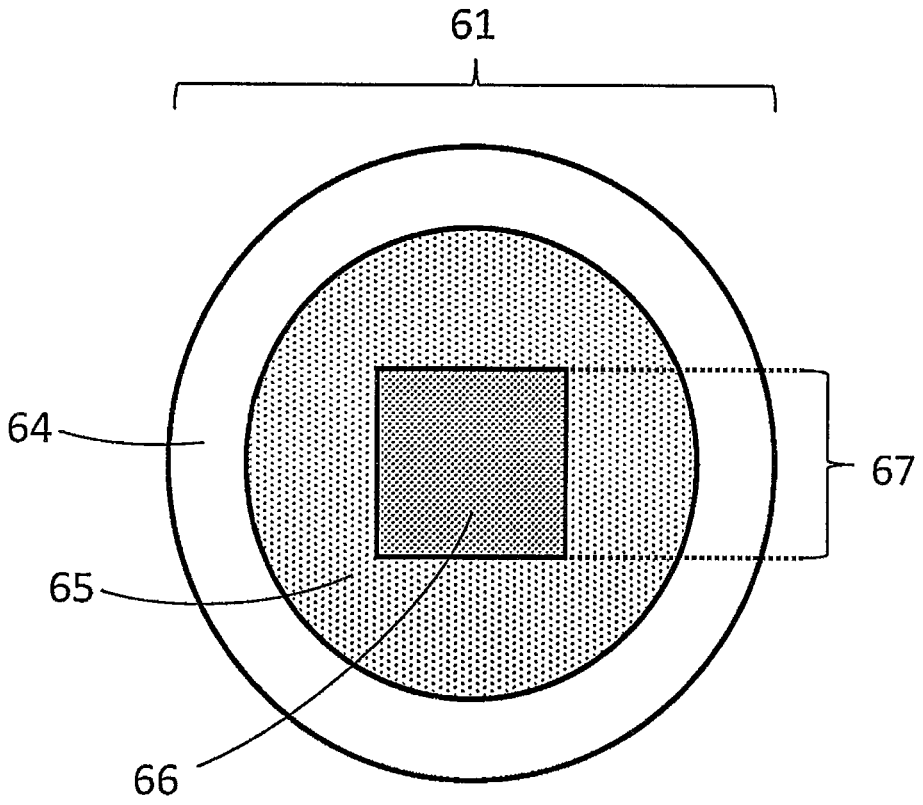
FIG. 6*b*: detail of the preferred embodiment of the present invention, illustration of an optical fibre with a shaped core.

FIG. 6*b* shows a possible configuration of an optical fibre 61. The optical fibre 61 consists of a sleeve 64, cladding 65 and a core 66. The operation of an optical fibre is well known and will not be described further within this application. The sleeve 64 is not necessary for the optical operation of the optical fibre 61 therefore may be removed if required. Additionally, it is possible for the cladding 65 to be removed if required without the operation mode described herein being affected significantly. The core 66 is shown to have a rectilinear shape 67. The rectilinear shape 67 may be imaged onto the light source to form an illumination spot. The image is, of course, the same shape as the core 66 of the optical fibre 61. Therefore, multiple optical fibre cores may be imaged onto a light source to form an array of illumination spots with the required shape. This is demonstrated by way of example in FIG. 5*b*. FIG. 5*b* shows an array 511 which is formed from rectilinear illumination spots 57. The array 511 may be formed into one without gaps between the illumination spots 57 by magnifying the cores 66 of the optical fibres 61 to the appropriate size. The shape of the core 66 is given as rectilinear 67, in FIG. 6*b*, by way of example, but should not be limited to such. The preferred shapes are ones that may be arranged into an array, for example triangles, squares, rectangles, parallelograms, rhomboids, hexagons etc, but may also consist of shapes which may not, for example circular, oval or pentagonal etc.

Further information on possible shapes, orientations and sizes of the illumination spots as formed upon the light source are outlined in further detail in co-pending application GB 1122183.5, the contents of which are hereby incorporated by reference.

The advantage of the current invention arises from the arrangement of the illuminations spots 57 on the light source 54 to give freedom in the creation of such a light source 54 with freely controllable spatial variation in the intensity of the emitted light without mechanical components in a default state. By this is meant that without further physical manipulation of the light beam generator 51 or optical control elements 514 the whole adaptive light source is still electronically switchable to a degree which is only limited by the number of laser emitters 52 utilised. The control of the relative position of the optical fibres 61 or optical control elements 514 adds further advantage by increasing the degree of adaptive control of the far-field beam spot. By this method, the limitation of a finite number of laser emitters 52 which is placed upon a purely static system is removed. The application of multiple laser emitters 52 coupled with fine adaptive control of the position of the illumination spots 57 upon the light source 54 can give a degree of redundancy of laser emitters 52, whereby one may be used to compensate for a reduction or output or failure of another of the laser emitters 52. Further arrangements of the light source 54, laser emitters 52 and the delivery of the light thereof will be described herein.

Figure 7A:
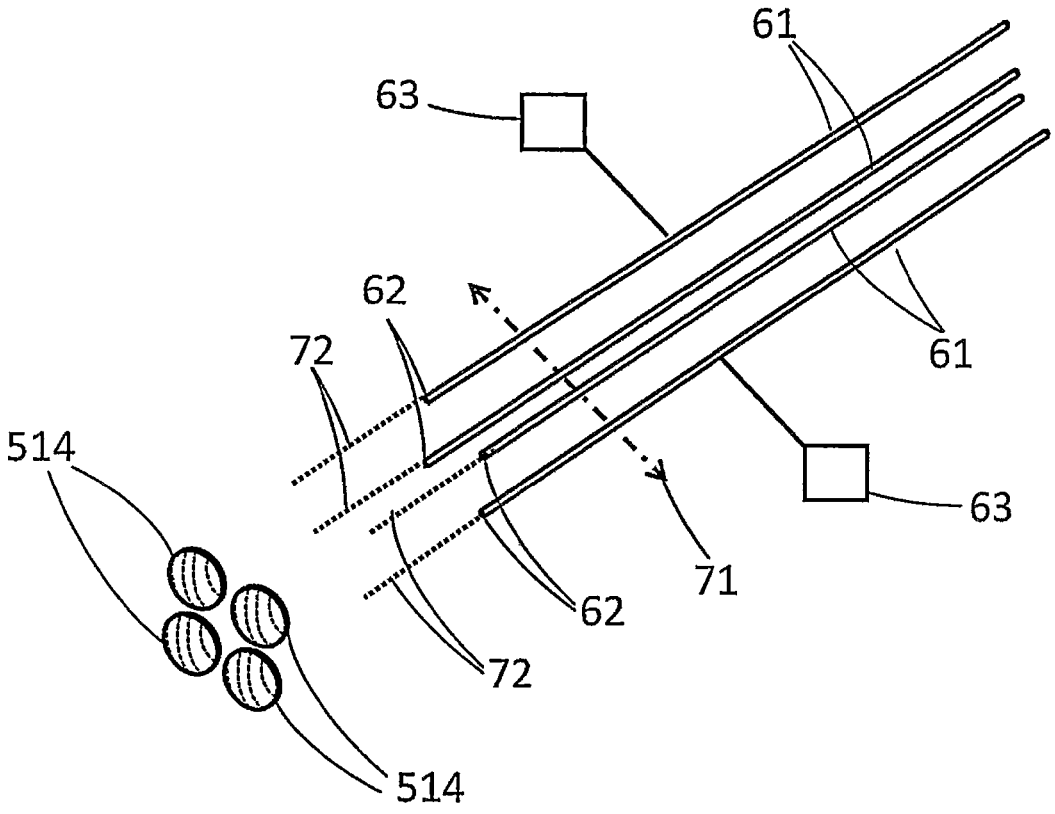
FIG. 7*a*: further embodiment of the present invention, a method by which the optical fibres may be moved laterally relative to the optical control elements.

FIG. 7*a* shows one method by which the optical fibres 61 are moved with respect to the optical control elements 514. For clarity only the end of optical fibre 61 is shown and the optical control element 514. The other elements of the light source system are omitted. The actuators 63 cause a lateral movement 71 of the optical fibres 61, but such that the ends of the optical fibres remain substantially aligned with the focal plane of the optical control elements 514. The actuators 63 thus form control means for controlling the incidence of light beams on respective optical control elements 514. The optical fibres 61 are free to move and therefore, the direction of the axis 72 of the optical fibre 61 remains at the same relative angle to the optical control elements 514 at all points in the movement. The lateral movement 71 may be up and down or left and right or a combination of both. In this instance the range of movement of the output face 62 of the optical fibre 61 is directly determined by the range of movement of the actuator 63.

Figure 7B:
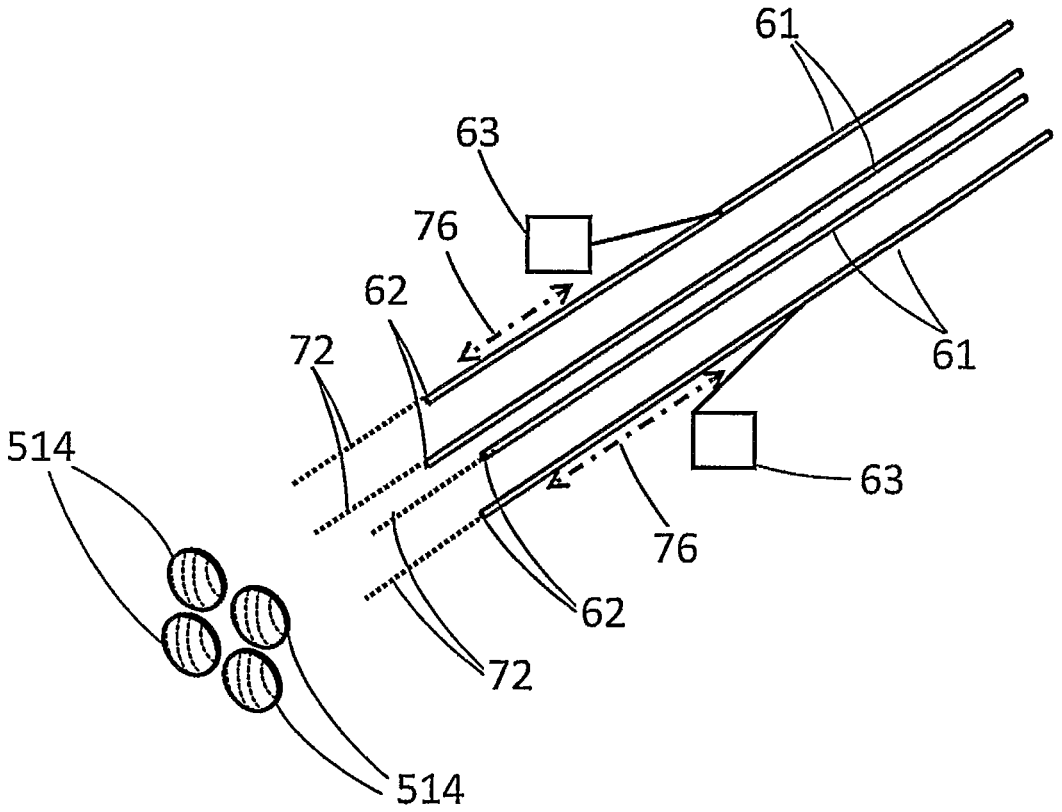
FIG. 7*b*: further embodiment of the present invention, a method by which the optical fibres may be moved axially relative to the optical control elements.

FIG. 7*b* shows a further method by which the optical fibres 61 may be moved with respect to the optical control elements 514. The actuators 63 cause an axially aligned linear movement 76 of the optical fibres 61 in a direction parallel to the axis 72 of the optical fibre 61. The axially aligned linear movement 76 will cause the output face 62 of the optical fibre 61 to move in and out of the focal plane of the optical control element 514. This movement will facilitate the change in size of the illumination spot as described in FIG. 5*d*. The actuators 63 thus form control means for controlling the incidence of light beams on respective optical control elements 514.

Figure 7C:
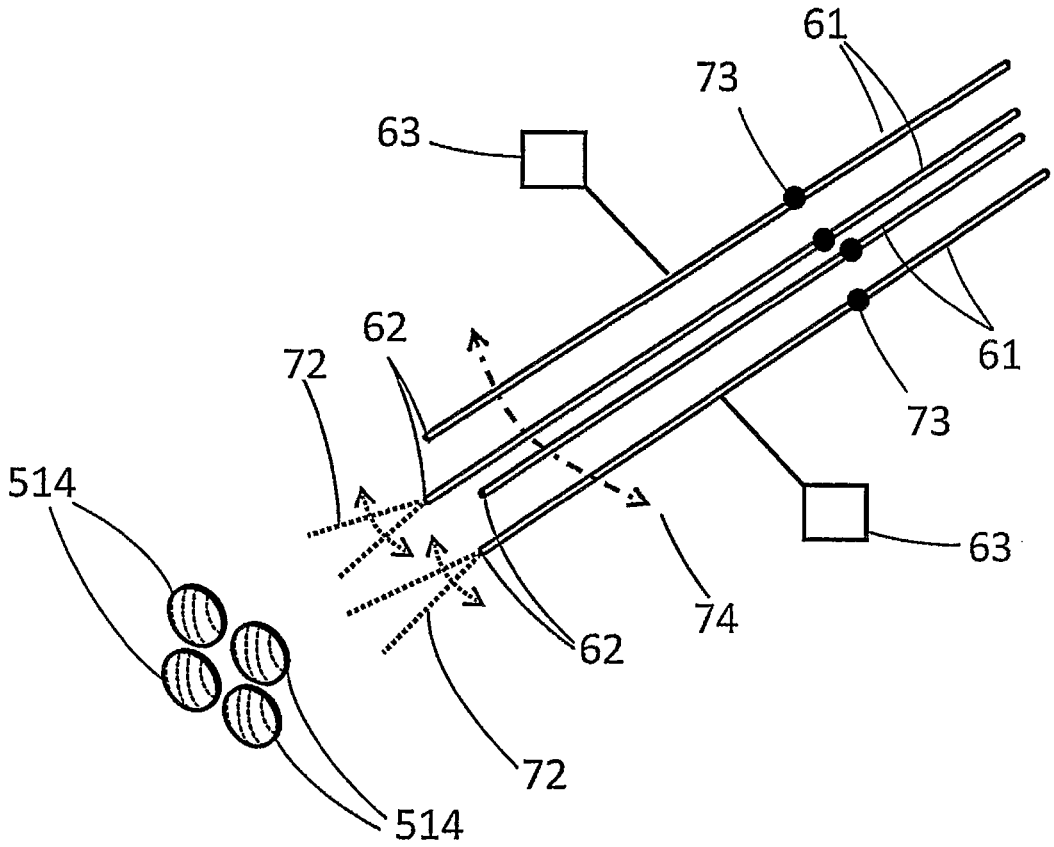
FIG. 7*c*: further embodiment of the present invention, a method by which the optical fibres may be rotated relative to the control optical elements.

FIG. 7*c* shows a further method by which the optical fibres 61 are moved with respect to the optical control elements 514. The actuators 63 cause a movement of the optical fibre 61 within the focal plane of the optical control elements 514. By contrast to FIG. 7*a*, the optical fibres 61 are held at a fixed position at an anchor point 73 at some point along their length, but are free to move along the length between the anchor point 73 and the actuator 63. The optical fibres thus a fixed first portion, being the portion extending from the end of the fibre that is nearer to the respective emitter (not shown) to the anchor point 73, and a moveable second portion that extends from the anchor point 73 towards the actuator 63 and to the end of the optical fibre 61 nearer to the optical control element 514. The moveable second portion of the optical fibre 61 is thus spaced from the fixed first portion along the length of the optical fibre. The movement of the actuator 63 relative to the anchor point 73 causes the second portion of the optical fibre to move in a direction generally perpendicular to the axis of the optical fibre 61, thereby causing a rotation movement 74 of the output face 62 of the optical fibre 61 relative to the optical control element 514. This rotation movement 74 is denoted by a change in direction of the direction of the axis 72 of the optical fibre 61 at the output surface 62. Only two axes 72 are shown for clarity. By such a control method the actuator 63 can cause a varying degree of movement of the output face 62 of the optical fibre 61 dependent on the actuators 63 position relative to the anchor point 73. The actuators 63 thus form control means for controlling the incidence of light beams on respective optical control elements 514. For example, consider an actuator 63 with a fixed range of movement. Placing the actuator 63 close to the anchor point 73 will cause a large degree of rotation movement 74 in the output face 62 of the optical fibre 61 relative to the optical control element 514. Conversely, placing the actuator 63 far away from the anchor point 74 will cause a much smaller range of rotation movement 74 in the output face 62 of the optical fibre 61.

Figure 7D:
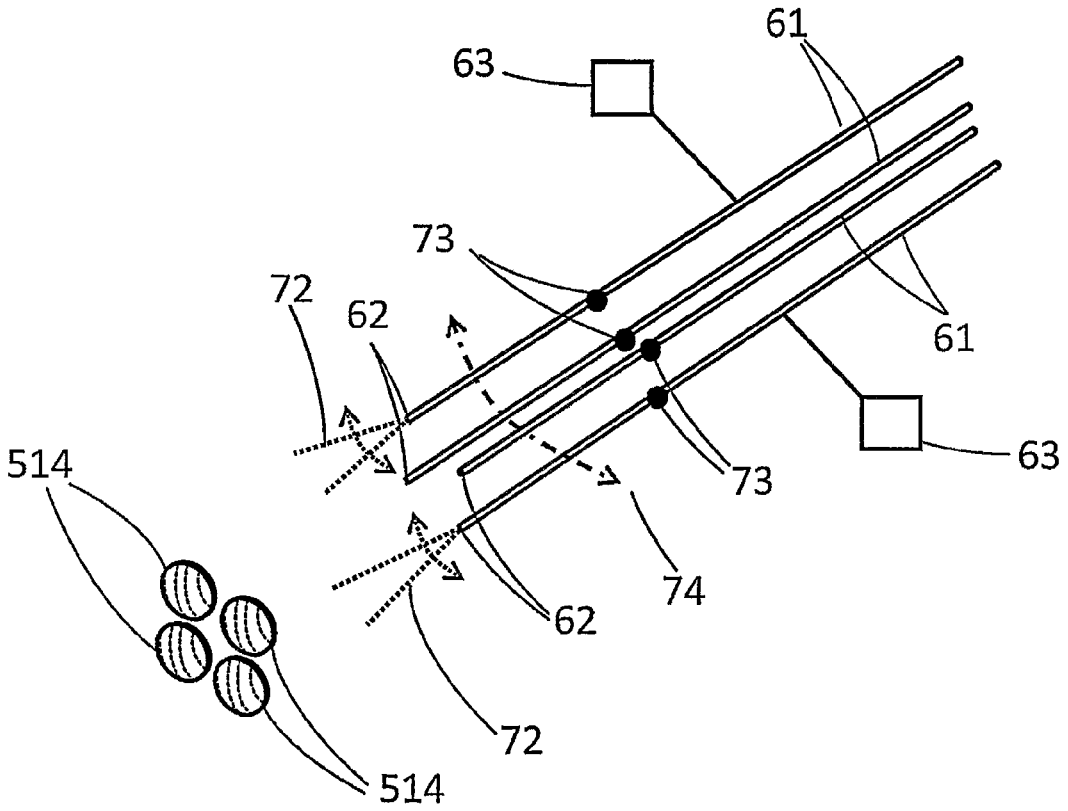
FIG. 7*d*: further embodiment of the present invention, a method by which the optical fibres may be rotated relative to the control optical elements.

FIG. 7*d* shows a further method by which the optical fibres 61 are moved with respect to the optical control elements 514. The optical fibres 61 are held at a pivot point 75 at a position between the actuator 63 and the output surface 62 of the optical fibre 61. The optical fibre 61 is free to rotate through the pivot point 75, but the pivot point 75 cannot be moved in space. Similarly the optical fibre 61 is free to move either side of the pivot point 75. Therefore, movement of the optical fibre 61, in a direction generally perpendicular to the axis of the optical fibre 61, caused by the actuator 63 results in a rotation movement 74 at the location of the output face 62 of the optical fibre 61. The actuators 63 thus form control means for controlling the incidence of light beams on respective optical control elements 514.

Figure 7E:
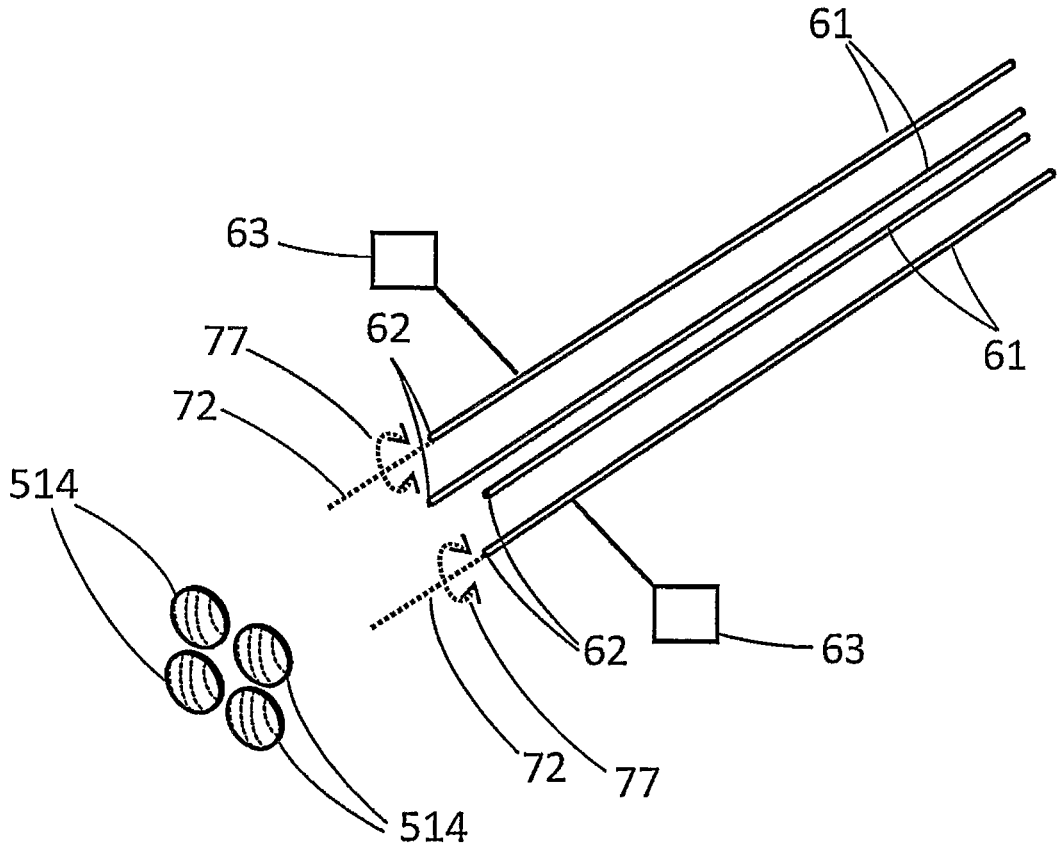
FIG. 7*e*: further embodiment of the present invention, a method by which the optical fibres may be rotated around their own axis relative to the optical control elements.

FIG. 7*e* shows a further method by which the optical fibres 61 may be moved with respect to the optical control elements 514. The optical fibres 61 undergo an axial rotation 77 around the direction of the axis 72, such that the direction of the axis 72 does not change. This causes a similar rotation in the orientation of the output face 62 of the optical fibres 61. The actuators 63 may be applied to the optical fibres 61 to provide the axial rotation 77. By this method, the optical fibres 61 are rotated relative to the orientation of the optical control elements 514. The actuators 63 that cause the axial rotation of the optical fibres thus form control means for controlling the incidence of light beams on respective optical control elements 514.

Figure 8A:
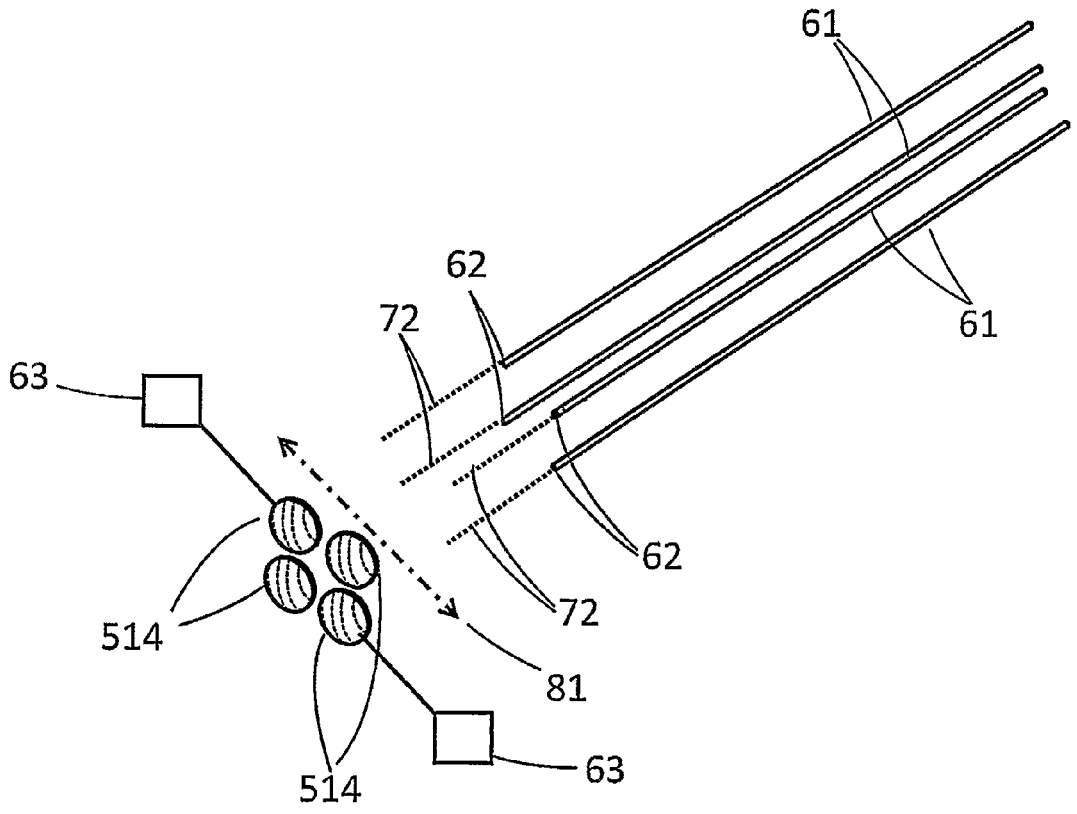
FIG. 8*a*: further embodiment of the present invention, a method by which the control optical elements may be moved laterally relative to the optical fibres.

FIG. 8*a* shows a further embodiment of the invention whereby the optical control elements 514 are moved with respect to the output face 62 of the optical fibres 61. The actuators 63 move the optical control elements 514 themselves. The actuators 63 thus form control means for controlling the incidence of light beams on respective optical control elements 514. In this example, a lateral movement 81 is applied to the optical control elements 514. No change in change in angle of the optical control elements 514 occurs relative to the axis 72 of the optical fibre 61.

Figure 8B:
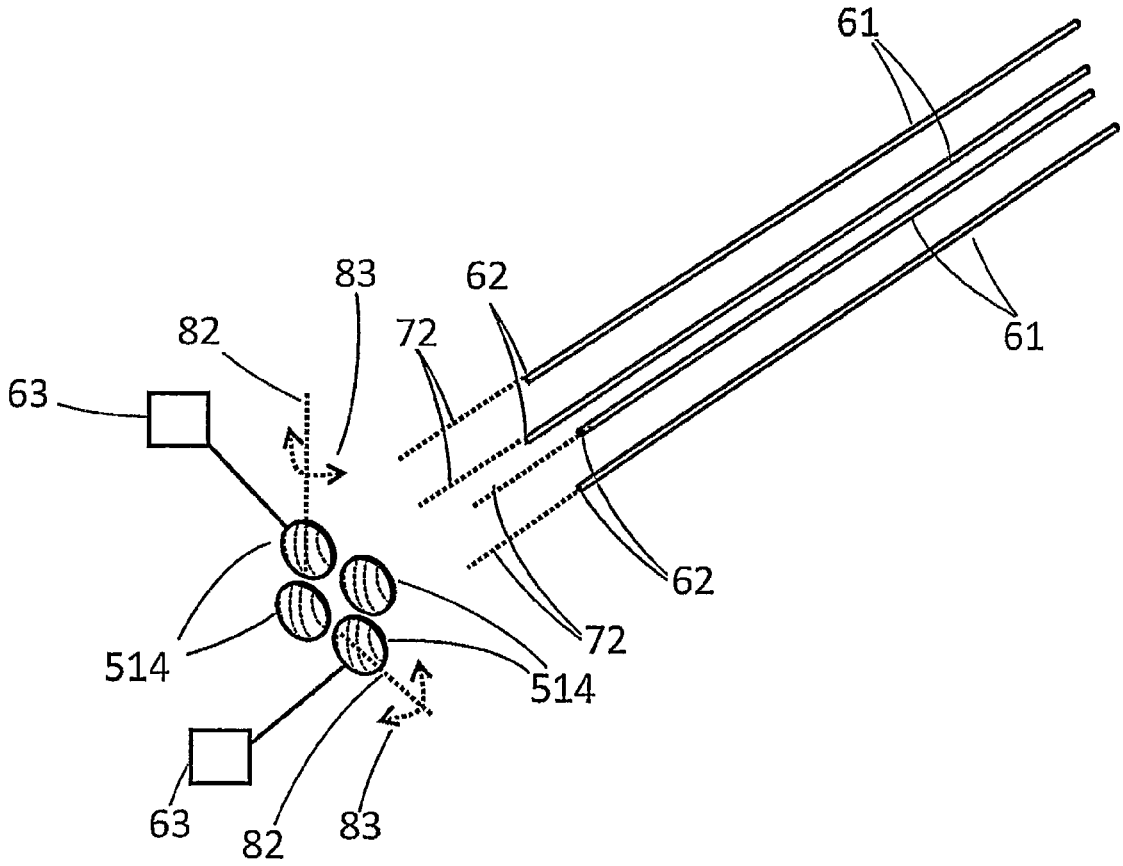
FIG. 8*b*: further embodiment of the present invention, a method by which the control optical elements may be rotated relative to the optical fibres.

FIG. 8*b* shows a further embodiment of the present invention whereby the optical control elements 514 are rotated with respect to the output face 62 of the optical fibre 61. The actuators 63 act to rotate the optical control elements 514 about a pivot point, denoted in this diagram by a pivot axis 82. Two examples of the pivot axis 82 are shown to highlight that the direction of the pivot axis 82 is not required to be fixed. This causes a rotation movement 83 of the optical control element 514 relative to the axis 72 of the optical fibre 61. The actuators 63 thus form control means for controlling the incidence of light beams on respective optical control elements 514.

Both the movements demonstrated in FIGS. 8*a* and 8*b* have the same effect on the re-direction of the light beams emitted from the optical fibres as caused by movement of the optical fibres relative to the optical control elements. Therefore, they may be considered equivalent to the movement demonstrated in FIGS. 7*a*-7*c*.

Figure 8C:
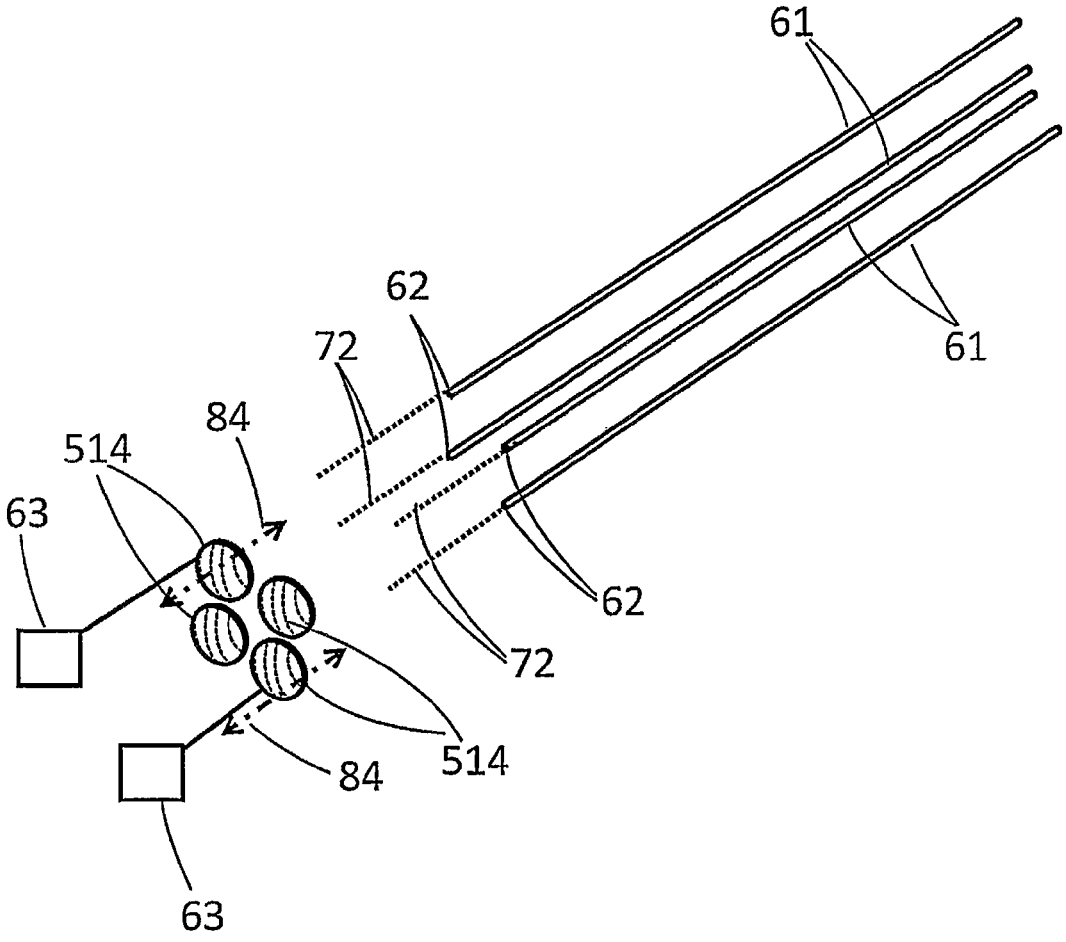
FIG. 8*c*: further embodiment of the present invention, a method by which the control optical elements may be moved axially relative to the optical fibres.

FIG. 8*c* shows a further embodiment of the present invention whereby the actuators 63 cause an axially aligned linear movement 84 of the optical control elements 514 relative to the axis 72 of the optical fibres 61. This movement will facilitate a change in the size of the illumination spots on the light source, as described in FIG. 5*d*. This effect is equivalent to the movement of the optical fibre as described in FIG. 7*b*. The actuators 63 thus form control means for controlling the incidence of light beams on respective optical control elements 514.

The embodiments of FIGS. 7*a* to 8*c* are again operable in at least first and second modes to provide at least first and second different far-field illumination patterns. For example these embodiments may include a light beam generator (not shown) that is operable in at least first and second modes in which it generates, respectively, first and second independently controllable sets of one or more light beams. These embodiments may for example include a light beam generator similar to the light beam generator 51 of FIG. 6*a*.

In the embodiments of FIGS. 7*a* to 8*c* the optical fibres 61 act as transmission components, as described with reference to FIG. 5*a*.

As in previous embodiments actuators 63 may be applied to any number of the optical control elements 514. As in previous embodiments, the actuators 63 are arranged such that they have a default position from which all movement occurs.

In any of the previous embodiments it is understood that actuators may be applied to the optical fibres 61 or optical control elements 514 such that any of the degrees of movement may be achieved either in isolation or in combination. Therefore, it is possible that multiple actuators may be applied to an individual optical fibre 61 or optical control element 514 to achieve the multiple degrees of movement, if required.

Figure 9:
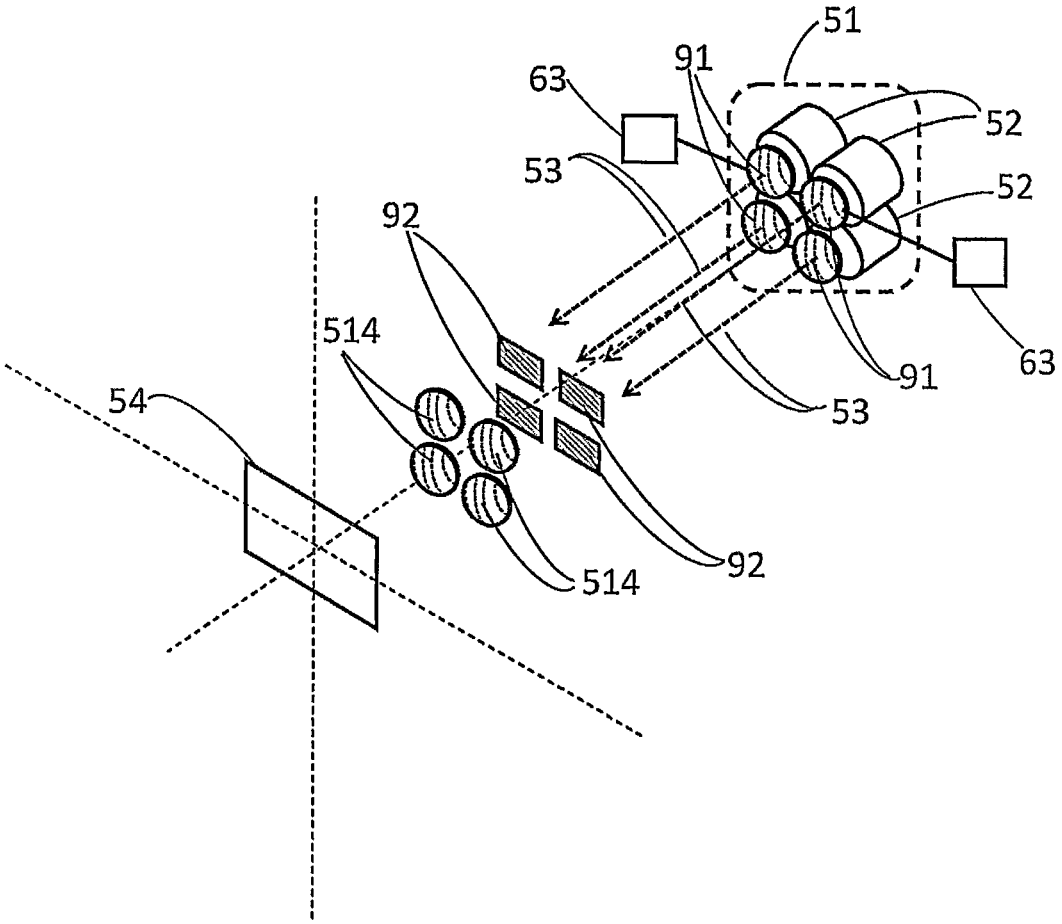
FIG. 9: further embodiment of the present invention, a method to produce a shaped distribution in the focal plane of the control optical element.

FIG. 9 shows a further embodiment of the present invention whereby the light beam generator 51 is comprised of multiple individual laser emitters 52 and multiple optical distribution components 91. The light beam generator 51 of FIG. 9 is again operable in at least first and second modes to obtain at least first and second different far-field illumination patters, for example as described with reference to FIG. 6*a* above. The optical distribution components 91 may be formed from optical elements such as refractive, or diffractive, optics which are designed to form a shaped distribution 92 of light in the focal plane of the optical control elements 514. An example of such an optical element is a top hat lens. Top hat lenses are designed to produce a flat distribution of a particular shape at a given image plane. Top hat lenses are well known and will not be described further. The shaped distribution 92 is shown as being rectangular in form in the figure, but should not be limited to such and may take on any or all of, but not be limited to, the following: square, triangular, pentagonal, hexagonal, circular, oval or in the form of a parallelogram, rhombus or any other shape which may be arranged into an array. By this arrangement, the shaped distributions 92 formed by the optical distribution components 91 are analogous to the output faces of the optical fibres shown in FIGS. 6 and other previous embodiments. The application of actuators to the optical control elements 514 is possible as described in FIGS. 8*a* and 8*b*. However, in this embodiment it is also possible to apply actuators 63 to the distribution optical elements 91 to move the shaped distributions 92 within the focal plane of the control optical elements 514. The actuators 63 that act on the distribution optical elements 91 thus form control means for controlling the incidence of light beams on respective optical control elements 514.

Figure 10A:
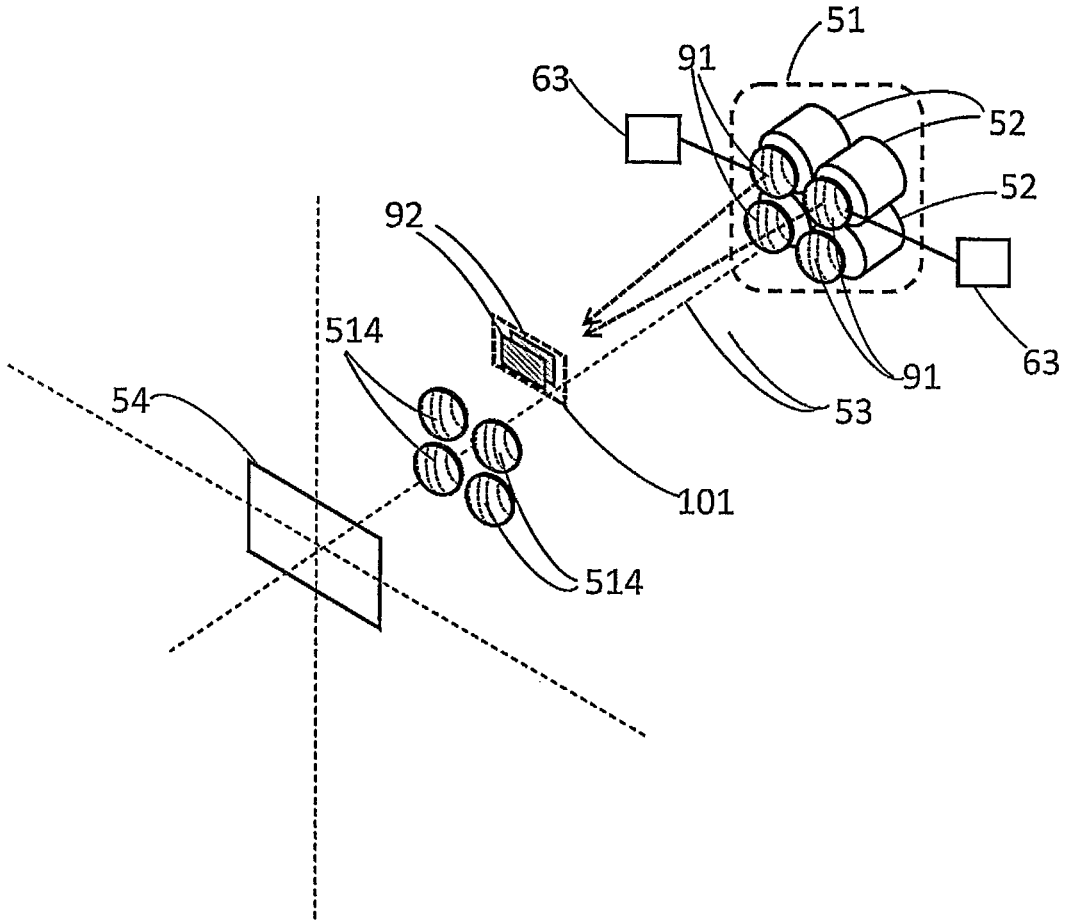
FIG. 10*a*: further embodiment of the present invention, combination of multiple shaped distributions into one compound shaped distribution by complete overlap.

FIG. 10*a* shows a further embodiment of the present invention whereby multiple shaped distributions 92 from multiple distribution optical elements 91 are overlaid in the focal plane of a single control optical element 514 to form a single compound shaped distribution 101. Therefore, a single compound distribution 101 is associated with each individual optical control element 514. In this instance only two light beams 53 and shaped distributions 92 are shown for clarity. However, it may be applied to as many light beams 53 and shaped distributions 92 utilised within the light source system. Furthermore, the combination of multiple shaped distributions 92 should not be limited to just two. In this embodiment the shaped distributions 92 are the same shape and size and are overlaid so that the overlap exactly. The size of the compound shaped distribution 101 in FIG. 10 is different to the individual shaped distributions 92 for clarity; it is not intended to show that a difference in size should occur. The overlap of shaped distributions 92 into one compound shaped distribution 101 has the advantage that the individual shaped distributions 92 can be separately controlled to provide yet further fine control of the brightness distribution within the far-field beam spot. The application of multiple shaped distributions 92 per individual control optical element 514 also allows a degree of redundancy within the laser beam generator 51, whereby if one laser emitter 52 should fail or decrease in brightness, no loss of functionality of the will immediately occur.

Figure 10B:
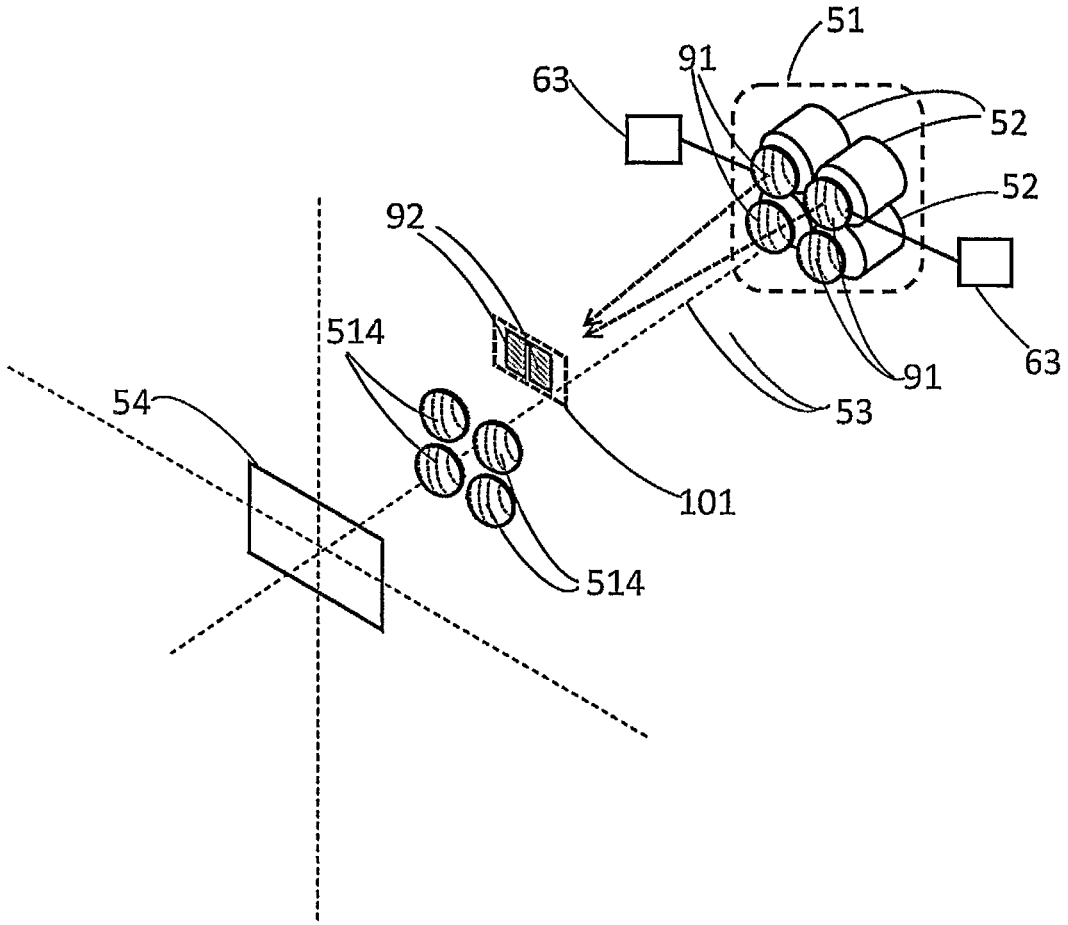
FIG. 10*b*: further embodiment of the present invention, combination of multiple shaped distributions into one compound shaped distribution by adjacent positioning.

FIG. 10*b* shows a further embodiment of the present invention whereby multiple shaped distributions 92 are positioned so as to be adjacent to one another within the compound shaped distribution 101. As in the previous embodiment, one compound shaped distribution 101 is associated with each optical control element 514. In this arrangement, finer detail may be achieved within the array of illumination spots on the light source 54.

Figure 10C:
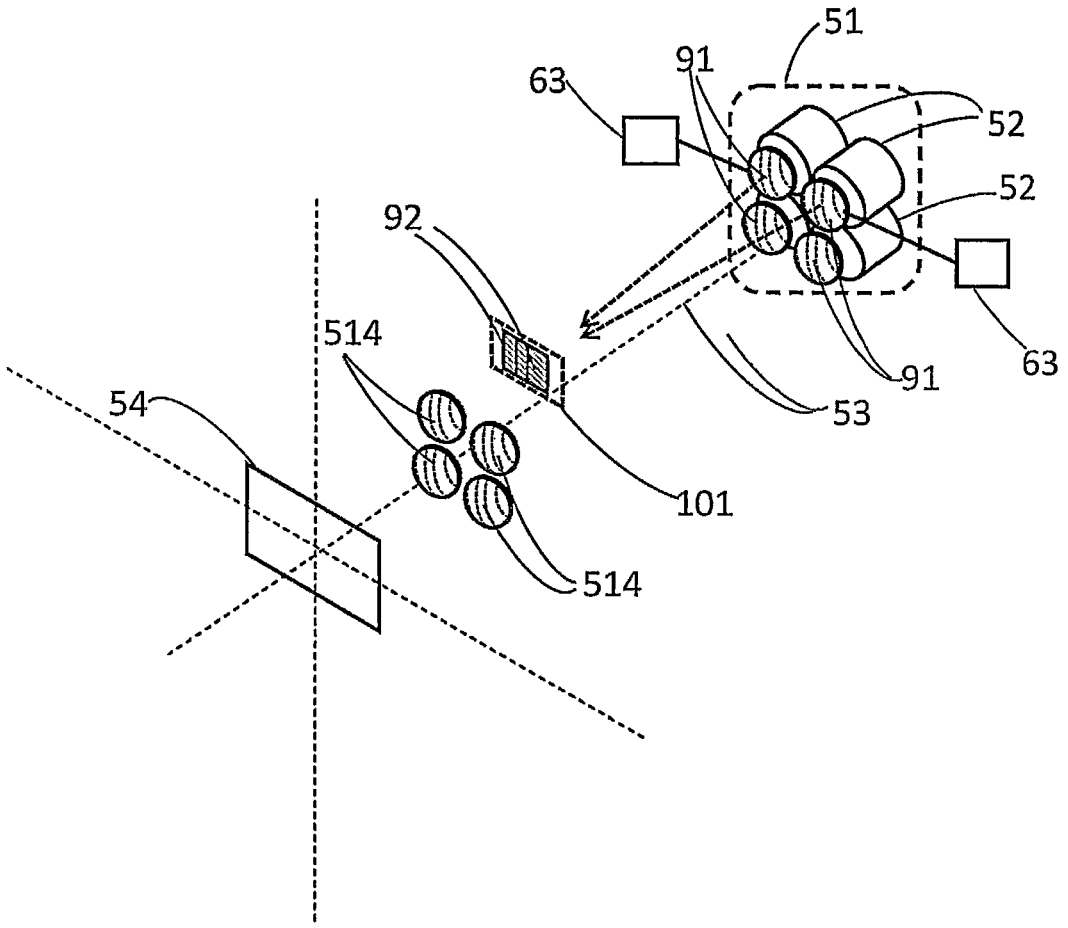
FIG. 10*c*: further embodiment of the present invention, combination of multiple shaped distributions into one compound shaped distribution by partial overlap.

FIG. 10*c* shows a further embodiment of the present invention whereby multiple shaped distributions 92 are combined into a single compound shaped distribution 101 in such a manner that partial overlap occurs between the multiple shaped distributions 92. This degree of overlap may range from no overlap to complete overlap, thereby encompassing the embodiments described in FIGS. 10*a* and 10*b* as the extremes of movement.

In the embodiments of FIGS. 10*a*, 10*b* and 10*c*, the light beam generator 51 is again operable in at least first and second modes to obtain at least first and second different far-field illumination patters, for example as described with reference to FIG. 6*a* above.

In the embodiments of FIGS. 10*a*, 10*b* and 10*c*, actuators 63 may act on the distribution optical elements 91, and so form control means for controlling the incidence of light beams on respective optical control elements 514.

It is understood that the individual shaped distributions 92 may be altered in size, as well as position, by the movement of the distribution control elements 91 associated with each one such that the size of each shaped distribution 92 may be individually controlled.

Figure 11:
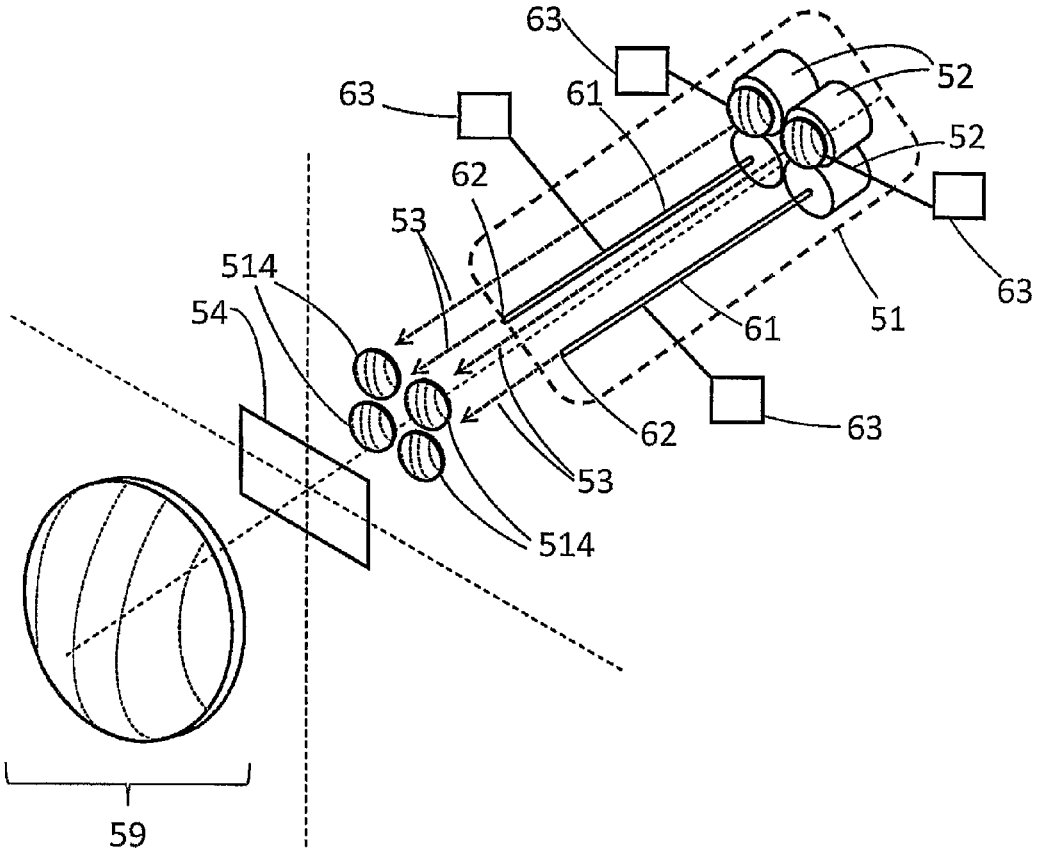
FIG. 11: a further embodiment of the present invention, a combination of distribution optical elements and optical fibres to generate the distributions fed to the optical control elements.

FIG. 11 shows a further embodiment of the invention whereby the light beam generator 51 is comprised of multiple individual laser emitters 52 and a combination of optical fibres 61 and distribution control components 91. The method by which the optical fibres 61 and/or distribution control components 91 are moved may be the same as explained in any of the previous embodiments, by the application of actuators 63. The actuators 63 form control means for controlling the incidence of light beams on respective optical control elements 514. The range and type of movements may the same as described in any of the previous embodiments.

In the embodiment of FIG. 11, the light beam generator 51 is again operable in at least first and second modes to obtain at least first and second different far-field illumination patters, for example as described with reference to FIG. 6*a* above. The optical fibres 61 act as transmission components, as described with reference to FIG. 5*a,*

Figure 12:
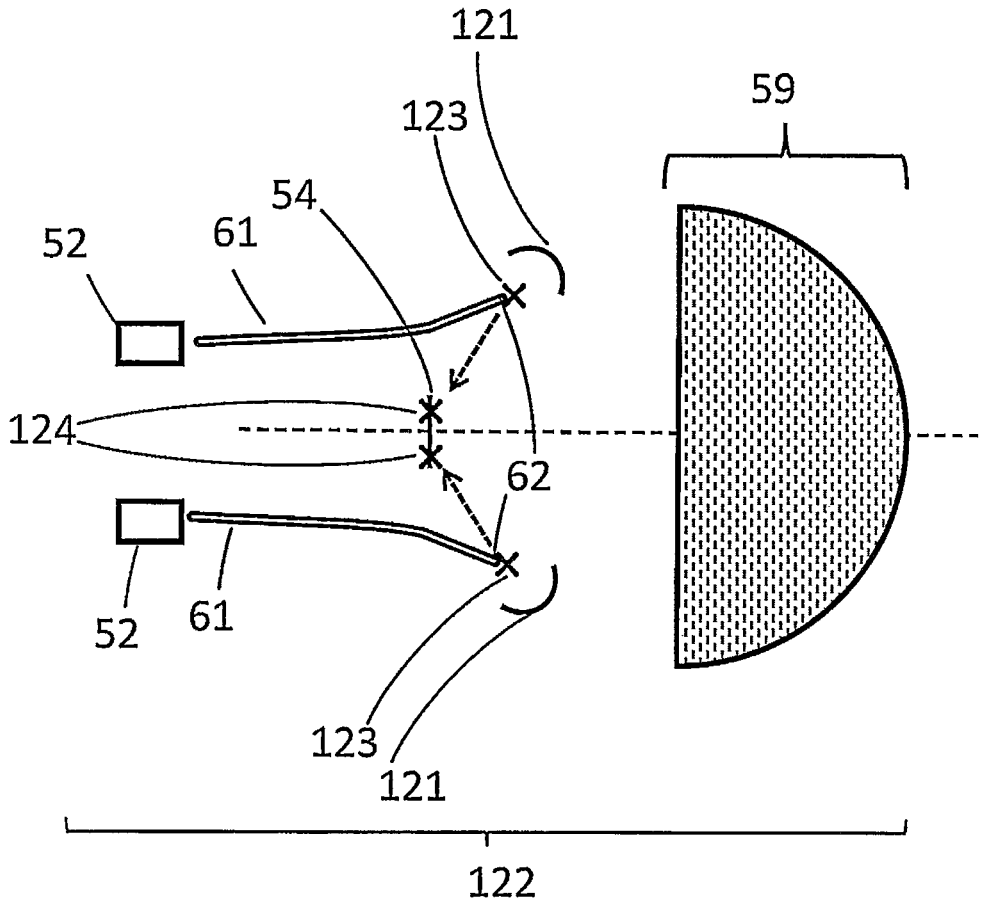
FIG. 12: a further embodiment of the present invention, the use of imaging reflectors to produce the illumination spot distribution upon the light source.

FIG. 12 shows a further embodiment of the present invention whereby the control optical elements are ellipsoidal reflectors 121 rather than lenses (such as the lenses 514 of FIG. 5*a*). The light source system 122 is shown in profile for clarity. The ellipsoidal reflectors 121 are shaped such that they have a first focal point 123 and a second focal point 124. Light from the first focal point 123 is directed to the second focal point 124, thereby allowing an image of the first focal point 123 to be formed at the second focal point 124. The first focal point 123 coincides with the output face 62 of the optical fibre 61. The second focal point 124 coincides with a point on the surface of the light source 54. Each of the second focal points 124 of the ellipsoidal reflectors 121 would generally be at a different location upon the light source 54. This allows the creation of an array of illumination spots upon the light source 54 in a manner similar to the main embodiment. This arrangement is distinct over prior art due to the application of imaging reflective surfaces and has advantage over the prior art due to the utilisation of the imaging reflectors to create an array of shaped illumination spots upon the surface of the light source 54, without the need for moving parts. As in previous embodiments, it is possible for a single illumination spot upon the light source 54 to be illuminated by the image created by more than one ellipsoidal reflector 121. This method of light control may be applied to other embodiments described within this present invention. Particularly, it is possible to apply the optical distribution components (91, FIG. 9) to produce a required brightness distribution at the first focal point 123. As in previous embodiments, it is possible to overlay the brightness distribution created by multiple brightness distribution components into a single compound distribution component as described in previous embodiments.

In the embodiment of FIG. 12, the light beam generator formed by the laser emitters 52 is again operable in at least first and second modes to obtain at least first and second different far-field illumination patters, for example as described with reference to FIG. 6*a* above. The optical fibres 61 act as transmission components, as described with reference to FIG. 5*a,*

The embodiment of FIG. 12 may be provided with actuators (not shown) to form a control means that controls the incidence of the light beams on respective ellipsoidal reflectors. If actuators are provided they may act on either the optical fibres 61 and/or the ellipsoidal reflectors, for example in any of the ways described above.

Figure 13:
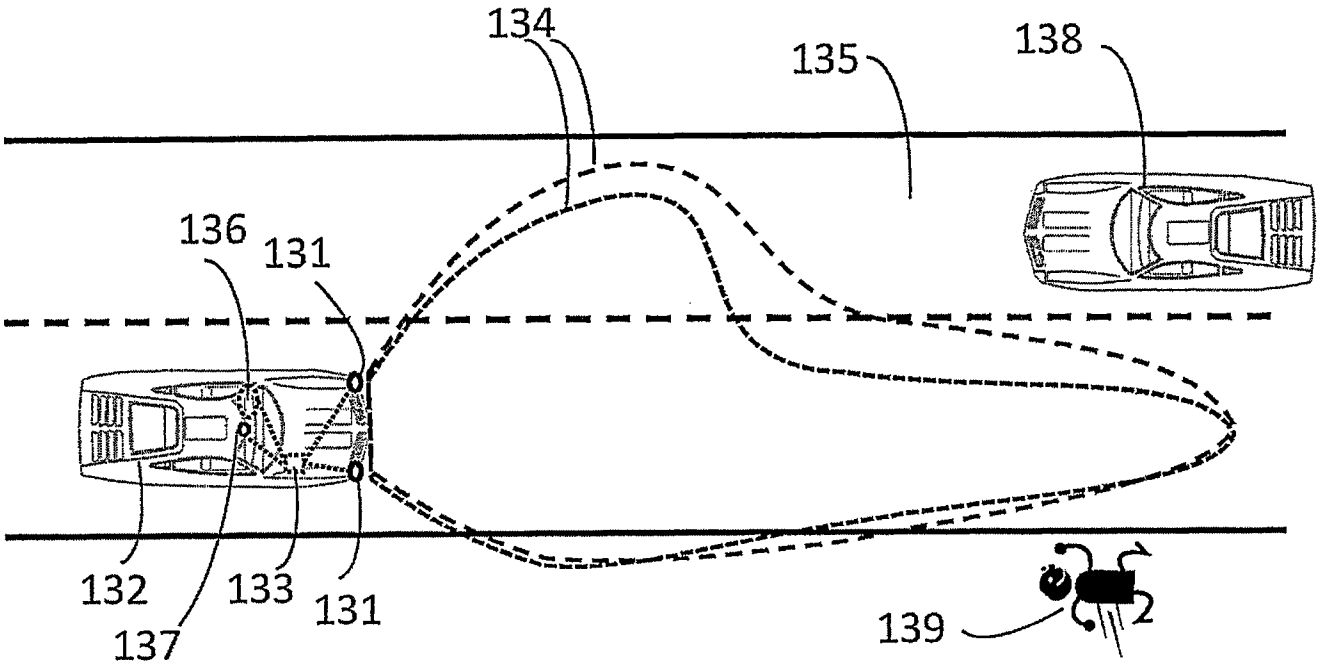
FIG. 13: system overview of the present invention.

FIG. 13 shows a system view how the present invention may be utilised. It may be used within the headlight unit 131 of an automobile 132. The headlight units 131 are controlled by a central control unit 133. The control unit changes the output from the headlight units 131 to alter the beam spot distribution 134 on the road 135 in response to input from either the driver console 136 or a signal from an automatic system which detects the conditions of the road 135, e.g. a camera 137. The beam spot may be modified to account for the presence of oncoming automobiles 138 or other hazards, for example a pedestrian 139 about to enter the road 135.

Although the invention has been shown and described with respect to a certain embodiment or embodiments, equivalent alterations and modifications may occur to others skilled in the art upon the reading and understanding of this specification and the annexed drawings. For example, in the above embodiments the position, size and/or orientation of at least one region of the photoluminescent material illuminated by a light beam is varied, but the invention is not limited to this. In further embodiments the shape of a region of the photoluminescent material illuminated by a light beam may be varied, either instead of or in combination with variation of the position, size and/or orientation. For example, where top-hat lenses are used as optical distribution components one or more of the top-hat lenses may be controlled to vary the shape of the cross-section of the respective light beam when two or more top hat lenses are paired to generate one distribution shape (that is, when the light distributions generated by the two or more lenses partially or wholly overlap with one another). Alternatively, if the positions of illuminated regions caused by two beams are caused to change relative to one another so that the two illuminated regions meet or overlap, this can also change the shape of an illuminated region—for example two beams may be controlled to generate either two separate square illuminated regions or one rectangular illuminated region by varying the position of one or both illuminated regions. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (Le., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

INDUSTRIAL APPLICABILITY

The present invention can be applied to the automotive industry and more specifically the provision of advanced adaptive front lighting systems to the headlights of automobiles.

SUPPLEMENTAL NOTES

A first aspect of the present invention provides a light source system operable in at least first and second modes to provide at least a first and second different far field illumination patterns, the system comprising: a photoluminescent material; a light beam generator for generating, in the first and second modes respectively, first and second independently controllable sets of one or more light beams for illuminating respective regions of the photoluminescent material, wherein the light beam generator comprises at least one semiconductor light emitting device spatially separated from the photoluminescent material; and a control means for controlling, in the first mode, the position, size, shape and/or orientation of at least one region of the photoluminescent material illuminated by a respective light beam of the first set of one or more light beams.

By specifying that the first and second sets of light beams are independently controllable is meant that the intensity and spatial arrangement of the light beam(s) of one set is controllable independently of the intensity of the beam, or of any of the light beams, of the other set, and optionally that the or any light beam of one set is controllable independently of the intensity of the or any light beam of the other set. (It should be noted that the region of the photoluminescent material that is illuminated by one set of light beams may or may not overlap the region of the photoluminescent material that is illuminated by another set of light beams.)

For the avoidance of doubt, the first set of light beams and/or the second set of light beams may consist of only a single light beam.

The photoluminescent material may be a fluorescent material, such as a fluorescent phosphor.

For the avoidance of doubt, the term "phosphor" as used herein includes a nanophosphor.

Also for the avoidance of doubt, a light system of the invention is not necessarily limited to operation in just the first and second modes and in principle may also be operable in further modes in addition to the first and second modes.

A light source system of the invention not only can provide different far-field illumination pattern (through being operable in either the first mode or in the second mode) but also can allow the far field illumination pattern obtained in at least the first mode to be varied, by controlling the position, size, shape and/or orientation of at least one region of the photoluminescent material that is illuminated in the first mode. This allows greater control over the illumination pattern that is provided. At the same time, compared to a conventional lighting system in which the far-field illumination pattern is varied solely by mechanical means (such as in JP 2011-134619), a light source system of the invention is more reliable—even if the control means should fail a light source system of the invention can still provide different far-field illumination patterns, since the switching of the light source system between the first mode and the second mode is independent of the control means and a failure of the control means does not affect the ability to operate in either the first or second modes of operation. Preferably, the control means is able to control the position, size, shape and/or orientation of a plurality of regions of the photoluminescent material illuminated by a respective light beam of the first set of one or more light beams, and may even control the position, size, shape and/or orientation of every region of the photoluminescent material illuminated by a respective light beam of the first set of light beams. If the control means is able to control the position, size and/or orientation of a plurality of regions of the photoluminescent material that are illuminated in the first mode, it may control the position, size, shape and/or orientation of at least one illuminated region of the photoluminescent material independently of the position, size, shape and/or orientation of another illuminated region of the photoluminescent material, or alternatively it may control the position, size, shape and/or orientation of every illuminated region of the photoluminescent material in the same way.

The control means may control the position, size, shape and/or orientation of one or more regions of the photoluminescent material in the second mode as well as in the first mode. (In embodiments in which the light source is operable in more than two modes, the control means may control the position, size, shape and/or orientation of one or more regions of the photoluminescent material in some or all of the further modes as well as in the first mode and optionally in second mode.)

The light beam generator may comprise a plurality of independently controllable semiconductor light emitting devices spatially separated from the photoluminescent material.

The system may comprise one or more optical control elements, each optical control element for directing one or more respective light beams towards the photoluminescent material; and the control means may control the incidence of the light beams on respective optical control elements. The optical control element(s) may for example be transmissive, or they may be reflective.

The system may comprise one or more transmission components for transmitting light beams towards the optical control elements.

The control means may be adapted to vary the position on an optical control element at which a respective light beam or respective light beams is/are incident on the optical control element.

The control means may be adapted to move at least one transmission component relative to a respective optical control element in a direction generally perpendicular to the axis of a light beam transmitted by the transmission component.

The control means may be adapted to move at least one transmission component relative to a respective optical control element in a direction generally parallel to the axis of a light beam transmitted by the transmission component.

The control means may be adapted to control the angle of incidence of at least one light beam on a respective optical control element.

The control means may be adapted to control the orientation at which at least one light beam is incident upon the photoluminescent material. A light beam will illuminate a region on the optical control element having a distribution which when imaged onto the photoluminescent material corresponds to the cross-sectional shape of the light beam at the object plane of the control optical element. If the light beam has a cross-section that is not circular, changing the orientation with which the light beam is incident on the optical control element will change (for example rotate about the axis of the light beam) the orientation of the region of the optical control element illuminated by the light beam, and hence will change the orientation of the illuminated region of the photoluminescent material.

The control means may be adapted to move at least one optical control element relative to the photoluminescent material in a direction generally parallel to an incident surface of the photoluminescent material.

The control means may be adapted to rotate at least one optical control element about an axis generally parallel to an incident surface of the photoluminescent material.

The control means may be adapted to move at least one optical control element relative to the photoluminescent material in a direction generally perpendicular to an incident surface of the photoluminescent material.

The control means may be adapted to move at least one transmission component relative to the light-emitting device (s).

The one or more transmission components may comprise at least one optical fibre. An optical fibre may have a core that is shaped similarly to the desired shape of an illumination region on the phosphor—for example an optical fibre with a square core will, when its output light is directed onto a surface along a direction generally perpendicular to the surface, generate an illumination region on the surface that is generally square in shape, etc.

The one or more transmission components may comprise at least one optical distribution component.

The one or more transmission components may comprise at least an optical fibre having a fixed first portion, and the control means may comprise an actuator for moving a second portion of the optical fibre in a direction generally perpendicular to the axis of the optical fibre, the second portion being spaced from the first portion along the length of the optical fibre. This is effective to vary the angle, relative to the incident surface of the photoluminescent material, of light emitted from the optical fibre and hence vary the angle of incidence of light on the optical control element. (The "incident surface of the photoluminescent material" is the surface of the photoluminescent material on which the light beams are incident.) Alternatively, this may be considered as varying the angle, relative to the optical axis of the light source system, of light emitted from the optical fibre.

The system may further comprise an optical system arranged to image light emitted from the photoluminescent material into the far field. As noted above, the shape of an illumination region on the phosphor may be chosen to have a desired shape, for example by use of an optical fibre with a core of that desired shape (or by other means, for example such as a top-hat lens that generates an illumination region of the desired shape). When light re-emitted from the photoluminescent material is imaged into the far field, the shape of a bright region in the intensity distribution formed in the far-field will correspond to the shape of the corresponding illumination region.

The semiconductor light emitting device(s) may be laser emitter(s).

An aspect of the invention provides a light source system operable in at least first and second modes to provide at least and first and second different far field illumination patterns, the system comprising: a photoluminescent material; and a light beam generator for generating at least two independently controllable sets of light beams for illuminating respective regions of the photoluminescent material; wherein the light beam generator comprises at least one semiconductor light emitting device spatially separated from the photoluminescent material; optical control elements to imaging the output from the light beam generator onto the photoluminescent material; the means to alter the relative positions of the output beams from the light beam generator and the optical control elements with respect to each other; a default position being provided for both the light beam generator and optical control components to allow for continuing function in the event of failure of the control mechanisms. By causing the generating means to generate one set of light beams so as to illuminate one region of the photoluminescent material, the one region of the photoluminescent material is caused to emit visible light and thus generate one far field illumination pattern, whereas causing the generating means to generate another set of light beams so as to illuminate another region of the photoluminescent material, the another region of the photoluminescent material is caused to emit visible light and thus generate another far field illumination pattern.

The prior art outlined above addresses the provision of a small headlight through the use of laser excitation of fluorescent materials and the ability to create both dipped and driving beam spot with some adaptive control. However, they do not allow for a high powered, switchable dipped to driving beam headlight with further adaptive control utilising an array of multiple laser emitters to create an array illumination leading to a shaped distribution which is imaged upon the phosphorescent material which can not only create the dipped and driving beam spots, but can also offer adaptive control of the range of beam spots possible and/or of the point where the cut-off is provided to obtain the dipped beam. This invention aims to address that deficiency. Furthermore, the present invention allows for the application of fine control of the adaptive function by fine control of the illumination array upon the fluorescent materials. The application method of the multiple laser emitters allows for possible failure of the fine control elements without loss of basic function of the small headlight function, this being the possibility to switch between the dipped and driving beams and provision of basic adaptive control. The application of multiple laser emitters with fine adaptive control also allows for redundancy of the laser emitters. Should one fail or reduce in brightness, it is possible for another to take over some of the functionality of the failed laser emitter. Furthermore, the current invention can provide for a projector-type headlight which can create a dipped beam profile without the use of a shield to remove light from the projected beam, thereby increasing optical efficiency of the headlight.

Furthermore in the lamp module of U.S. Pat. No. 7,654,712 each light emission part is located adjacent to the associated fluorescent substance. In operation the light emission part and the fluorescent substance will both generate heat, and because the light emission part is located adjacent to the associated fluorescent substance it will be difficult to remove this waste heat efficiently. In the present invention, however, the semiconductor light emitting device(s) are spatially separated from the photoluminescent material, so that the waste heat generated by the semiconductor light emitting device can be dealt with separately from the waste heat generated by the photoluminescent material.

The light beam generator may comprise a plurality of independently controllable semiconductor light emitting devices spatially separated from the photoluminescent material, each generating a respective beam.

The light source system may further comprise an optical system arranged to image light emitted from the photoluminescent material into the far field.

The semiconductor light emitting device(s) may be laser emitter(s) or they may be light emitting diode(s).

The light beam generator may comprise multiple light emitting devices which are associated with multiple optical fibres, the output faces of which comprise the emission locations of light beams from the light beam generator.

The light beam generator in which each of the multiple light emitting devices are associated with individual optical fibres.

The optical fibres within the light beam generator having a core with a specific shape to allow the effective creation of an illumination array upon the photoluminescent material.

Single optical fibres are associated with individual optical control elements.

The light beam generator may further comprise at least one light emitting device which is associated with a free space optical distribution components; the free space optical distribution components designed to produce a brightness distribution of required size, shape and orientation at a given location in space.

Single free space optical distribution components are associated with individual optical control elements.

Multiple free space optical distribution components are associated with a single optical control element.

The compound distributions from the multiple free space optical distribution components are comprised of individual distributions abutted to each other.

The compounds distributions of the free space optical distribution components are comprised of individual distributions fully overlaid upon each other.

The distributions of the free space optical distribution components are comprised of individual distributions partially overlaid upon each other.

The individual distributions within the compound distribution may be independently controlled.

The light beam generator in which each of the multiple light emitting devices are associated with individual optical distribution components.

The light beam generator designed to generate a brightness distribution in the image focal plane of a optical control element.

The light beam generator designed to generate a brightness distribution at the image focal point of a optical control element.

The optical control elements are arranged to image the output from the light beam generator onto the photoluminescent material.

The optical control element may comprise an imaging refractive lens.

The optical control element may comprise an imaging diffractive lens.

The optical control element may comprise an imaging reflective surface.

A light source system in which a default position for the illumination array is provided for by the initial position of the illumination spots upon the photoluminescent material.

A light source system in which fine adaptive control of a far-field beam spot distribution may be realised by movement of the output of the light beam generator with respect to the optical control elements.

A light source system in which the fine adaptive control is realised by the application of actuators to different optical components.

A light source system in which the fine adaptive control is realised by application of actuators to the optical fibres.

A light source system in which the fine adaptive control is realised by application of actuators to the distribution optical components.

A light source system in which the fine adaptive control is realised by application of actuators to the optical control elements.

A light source system in which the movement of the illumination spots may be achieved by the linear change of the relative position of the optical control elements and the output distribution from the light beam generator.

The movement of the illumination spots caused by lateral movement of the optical fibres with respect to the optical control elements.

The movement of the illumination spots caused by rotational movement of the optical fibres with respect to the optical control elements.

The rotational movement of the optical fibres achieved by actuators located closer to the end of the optical fibre than an anchor point.

The rotational movement of the optical fibres achieved by actuators located further from the end of the optical fibre than a pivot point.

The movement of the illumination spots caused by movement parallel to the axis of the optical fibres with respect to the optical control elements.

The movement of the illumination spots caused by rotational movement around the axis of the optical fibres with respect to the optical control elements.

The movement of the illumination spots caused by lateral movement of the optical control elements with respect to the optical fibres.

The movement of the illumination spots caused by rotational movement of the optical control elements with respect to the optical fibres about an axis passing through the optical control element.

The movement of the illumination spots caused by movement of the optical control elements with respect to the optical fibres along the axis of the optical fibre.

The movement of the illumination spots caused by the lateral movement of the optical distribution components relative to the optical control elements.

The array of illumination spots upon the photoluminescent material is comprised of multiple shapes, size or orientations as outlined in co-pending UK patent application No. 1122183.5.

The configuration of projection optical systems as outlined in co-pending UK patent application No. 1122183.5.

A second aspect of the invention provides a headlight comprising any of the system defined above.

A third aspect of the invention provides a vehicle comprising a headlight of the second aspect.

The invention claimed is:

1. A light source system operable in at least first and second modes to provide at least first and second different far field illumination patterns, the system comprising:

a photoluminescent material;

a light beam generator for generating, in the first and second modes respectively, first and second independently controllable sets of one or more light beams for illuminating respective regions of the photoluminescent material, wherein the light beam generator comprises at least one semiconductor light emitting device spatially separated from the photoluminescent material;

one or more transmission components comprising at least one optical fibre, the one or more transmission components for transmitting light beams towards optical control elements, each optical control element for directing one or more respective light beams towards the photoluminescent material; and a control means for controlling, in the first mode, movement of the optical control elements and/or the one or more transmission components for controlling the incidence of the light beams on respective optical control elements so as to control the position, size, shape and/or orientation of at least one region of the photoluminescent material illuminated by a respective light beam of the first set of one or more light beams.

2. A system as claimed in claim 1 wherein the control means is adapted to control, in the first mode, the position, size, shape and/or orientation of a plurality of regions of the photoluminescent material illuminated by a respective light beam of the first set of one or more light beams.

3. A system as claimed in claim 1 wherein the light beam generator comprises a plurality of independently controllable semiconductor light emitting devices spatially separated from the photoluminescent material.

4. A system as claimed in claim 1, wherein the control means is adapted to vary the position on an optical control element at which one or more respective light beams is/are incident on the optical control element.

5. A system as claimed in claim 1, wherein the control means is adapted to move at least one transmission component relative to a respective optical control element in a direction generally perpendicular to the axis of a light beam transmitted by the transmission component.

6. A system as claimed in claim 1, wherein the control means is adapted to move at least one transmission component relative to a respective optical control element in a direction generally parallel to the axis of a light beam transmitted by the transmission component.

7. A system as claimed in claim 1 wherein the control means is adapted to control the angle of incidence of at least one light beam on a respective optical control element.

8. A system as claimed in claim 1 wherein the control means is adapted to control the orientation at which at least one light beam is incident on a respective optical control element.

9. A system as claimed in claim 1 wherein the control means is adapted to move at least one optical control element relative to the photoluminescent material in a direction generally parallel to an incident surface of the photoluminescent material.

10. A system as claimed in claim 1 wherein the control means is adapted to rotate at least one optical control element about an axis generally perpendicular to the axis of a respective light beam.

11. A system as claimed in claim 1 wherein the control means is adapted to move at least one optical control element relative to the photoluminescent material in a direction generally perpendicular to an incident surface of the photoluminescent material.

12. A system as claimed in claim 1 wherein the control means is adapted to move at least one transmission component relative to the light-emitting device(s).

13. A system as claimed in claim 1, wherein the one or more transmission components comprise at least one optical distribution component.

14. A system as claimed in claim 7, wherein the one or more transmission components comprise at least an optical fibre having a fixed first portion, and the control means comprises an actuator for moving a second portion of the optical fibre in a direction generally perpendicular to the axis of the optical fibre, the second portion being spaced from the first portion along the length of the optical fibre.

15. A system as claimed in claim 1 and further comprising an optical system arranged to image light emitted from the photoluminescent material into the far field.

16. A system as claimed in claim 1 wherein the semiconductor light emitting device(s) is/are laser emitter(s).

17. A headlight for a vehicle, the headlight comprising:

a system as defined in claim 1; and a control unit wherein the control unit changes an output of the s stem to alter a beam spot distribution on a road.

18. A vehicle comprising:

a headlight as defined in claim 17; and a drive console, wherein the headlight is responsive to an input from the drive console to change the output of the system to after the beam spot distribution on the road.

19. A system as claimed in claim 1, wherein the respective optical control elements are independently controlled to illuminate different respective regions of the photoluminescent material, and wherein, in response to the independently controlled movement of the optical control elements, the different respective illuminated regions cooperate with one another to define different compound shaped distribution regions of the photoluminescent material in which the respective illuminated regions are adjacent to one another with no overlap or only partial overlap.

20. A light source system operable in at least first and second modes to provide at least first and second different far field illumination patterns, the system comprising:

a photoluminescent material;

a light beam generator for generating, in the first and second modes respectively, first and second independently controllable sets of one or more light beams for illuminating respective regions of the photoluminescent material, wherein the light beam generator comprises at least one semiconductor light emitting device spatially separated from the photoluminescent material;

one or more transmission components comprising at least one optical fibre, the one or more transmission components for transmitting light beams towards optical control elements, each optical control element for directing one or more respective light beams towards the photoluminescent material; and a control means for controlling, in the first mode, movement of the one or more transmission components for controlling the incidence of the light beams on respective optical control elements so as to control the position, size, shape and/or orientation of at least one region of the photoluminescent material illuminated by a respective light beam of the first set of one or more light beams.

* * * * *